US007300348B2

(12) United States Patent
Kaminkow et al.

(10) Patent No.: US 7,300,348 B2
(45) Date of Patent: Nov. 27, 2007

(54) GAMING DEVICE HAVING A MASKED AWARD GAME

(75) Inventors: Joseph E. Kaminkow, Reno, NV (US); Bayard S. Webb, Sparks, NV (US)

(73) Assignee: IGT, Reno, NV (US)

( * ) Notice: Subject to any disclaimer, the term of this patent is extended or adjusted under 35 U.S.C. 154(b) by 672 days.

(21) Appl. No.: 10/210,540

(22) Filed: Jul. 31, 2002

(65) Prior Publication Data

US 2004/0023708 A1 Feb. 5, 2004

(51) Int. Cl.
*A63F 9/24* (2006.01)

(52) U.S. Cl. ..... 463/17; 463/18; 463/19

(58) Field of Classification Search ..... 273/237, 273/238, 265, 146, 138.1, 138.2; 463/16–22
See application file for complete search history.

(56) References Cited

U.S. PATENT DOCUMENTS

| | | | | |
|---|---|---|---|---|
| 1,527,929 | A | 2/1925 | Simons | |
| 3,152,805 | A * | 10/1964 | McGinn | 273/237 |
| 3,376,041 | A * | 4/1968 | Anderson | 273/238 |
| 3,640,536 | A * | 2/1972 | Godmer | 273/238 |
| 3,642,287 | A | 2/1972 | Lally et al. | |
| 4,508,357 | A | 4/1985 | Reich | |
| 4,560,161 | A | 12/1985 | Hamano | |
| 4,695,053 | A | 9/1987 | Vazquez, Jr. et al. | |
| 4,775,155 | A | 10/1988 | Lees | |
| 5,324,041 | A | 6/1994 | Boylan et al. | |
| 5,401,024 | A * | 3/1995 | Simunek | 463/18 |
| 5,584,764 | A | 12/1996 | Inoue | |
| 5,609,524 | A | 3/1997 | Inoue | |
| 5,722,891 | A | 3/1998 | Inoue | |
| 5,919,091 | A | 7/1999 | Bell et al. | |
| 5,927,714 | A | 7/1999 | Kaplan | |
| 5,935,002 | A | 8/1999 | Falciglia | |
| 5,988,643 | A | 11/1999 | Awada | |
| 5,989,121 | A | 11/1999 | Sakamoto | |
| 5,996,997 | A | 12/1999 | Kamille | |
| 5,997,401 | A | 12/1999 | Crawford | |
| 6,015,346 | A | 1/2000 | Bennett | |
| 6,033,307 | A | 3/2000 | Vancura | |
| 6,068,552 | A * | 5/2000 | Walker et al. | 463/21 |

(Continued)

FOREIGN PATENT DOCUMENTS

GB 2 201 821 9/1987

(Continued)

OTHER PUBLICATIONS

Electronic Battleship, circa 1977-1982.*

(Continued)

*Primary Examiner*—Ronald Laneau
*Assistant Examiner*—Travis Banta
(74) *Attorney, Agent, or Firm*—Bell, Boyd & Lloyd LLP

(57) ABSTRACT

A gaming device having a game with a grid which has a plurality of segments. The grid segments are defined by a plurality of independently selectable first coordinates and second coordinates. The gaming device provides the player with a number of opportunities to select segments of the grid and obtain awards by independently selecting both a first coordinate and a second coordinate.

76 Claims, 23 Drawing Sheets

U.S. PATENT DOCUMENTS

| | | | | |
|---|---|---|---|---|
| 6,089,976 | A | 7/2000 | Schneider et al. | |
| 6,093,102 | A * | 7/2000 | Bennett | 463/20 |
| 6,102,798 | A * | 8/2000 | Bennett | 463/16 |
| 6,105,962 | A | 8/2000 | Malavazos et al. | |
| 6,126,542 | A | 10/2000 | Fier | |
| 6,129,355 | A | 10/2000 | Hahn et al. | |
| 6,135,882 | A | 10/2000 | Kadlic | |
| 6,135,885 | A | 10/2000 | Lermusiaux | |
| 6,146,271 | A | 11/2000 | Kadlic | |
| 6,149,156 | A | 11/2000 | Feola | |
| 6,149,157 | A | 11/2000 | Suan | |
| 6,159,097 | A | 12/2000 | Gura | |
| 6,159,098 | A | 12/2000 | Slomiany et al. | |
| 6,164,652 | A | 12/2000 | Lauretta et al. | |
| 6,174,235 | B1 * | 1/2001 | Walker et al. | 463/25 |
| 6,190,254 | B1 | 2/2001 | Bennett | |
| 6,190,255 | B1 | 2/2001 | Thomas et al. | |
| 6,227,969 | B1 | 5/2001 | Yoseloff | |
| 6,227,971 | B1 | 5/2001 | Weiss | |
| 6,231,442 | B1 | 5/2001 | Mayeroff | |
| 6,234,897 | B1 | 5/2001 | Frohm et al. | |
| 6,261,177 | B1 | 7/2001 | Bennett | |
| 6,309,299 | B1 | 10/2001 | Weiss | |
| 6,312,334 | B1 | 11/2001 | Yoseloff | |
| 6,315,664 | B1 | 11/2001 | Baerlocher et al. | |
| 6,319,124 | B1 | 11/2001 | Baerlocher et al. | |
| 6,336,860 | B1 | 1/2002 | Webb | |
| 6,346,043 | B1 | 2/2002 | Colin et al. | |
| 6,347,996 | B1 | 2/2002 | Gilmore et al. | |
| 6,364,766 | B1 | 4/2002 | Anderson et al. | |
| 6,364,767 | B1 * | 4/2002 | Brossard et al. | 463/20 |
| 6,398,644 | B1 | 6/2002 | Perrie et al. | |
| 6,406,369 | B1 | 6/2002 | Baerlocher et al. | |
| 6,413,160 | B1 | 7/2002 | Vancura | |
| 6,443,837 | B1 | 9/2002 | Jaffe et al. | |
| 6,464,582 | B1 * | 10/2002 | Baerlocher et al. | 463/20 |
| 6,485,367 | B1 * | 11/2002 | Joshi | 463/13 |
| 6,506,117 | B2 | 1/2003 | DeMar et al. | |
| 6,561,512 | B2 | 5/2003 | Luciano et al. | |
| 6,572,471 | B1 * | 6/2003 | Bennett | 463/16 |
| 6,572,473 | B1 * | 6/2003 | Baerlocher | 463/20 |
| 6,585,591 | B1 * | 7/2003 | Baerlocher et al. | 463/25 |
| 6,605,000 | B2 | 8/2003 | Adams | |
| 6,626,757 | B2 | 9/2003 | Oliveras | |
| 6,644,664 | B2 * | 11/2003 | Muir et al. | 273/146 |
| 6,645,071 | B2 * | 11/2003 | Perrie et al. | 463/16 |
| 6,663,488 | B1 | 12/2003 | Adams | |
| 6,705,944 | B2 | 3/2004 | Luciano | |
| 6,942,567 | B2 * | 9/2005 | Baerlocher et al. | 463/16 |
| 2002/0137559 | A1 | 9/2002 | Baerlocher | |
| 2003/0036420 | A1 | 2/2003 | Baerlocher et al. | |
| 2003/0045338 | A1 | 3/2003 | Dolloff et al. | |
| 2003/0064773 | A1 | 4/2003 | Baerlocher et al. | |
| 2003/0144048 | A1 * | 7/2003 | Silva | 463/16 |

FOREIGN PATENT DOCUMENTS

| | | | |
|---|---|---|---|
| WO | WO 98/09259 | * | 3/1998 |
| WO | WO 2004/012159 | | 2/2004 |

OTHER PUBLICATIONS

Fortune Cookie Advertisement written by IGT, published in 2000.
Fortune Cookie Advertisement (website) written by www.igt.com, printed Mar. 21, 2001.
Slot Toppers Article written by Strictly Slots, published in 2000.
Battleship Article written by Strictly Slots, published in 2000.
Battleship Advertisement (website) written by www.mikohn.com, printed Apr. 25, 2001.
Ghost Hunter Advertisement, written by Atronic, published in 2003.
Magic 8 Ball Advertisement, written by IGT, published in 2003.
One page sheet showing and describing a 1977 Bally Monte Carlo game.
The Price is Right Brochure, written by IGT, published in 2001.
Slot City "Anchor Games Unveils 'City of Slots,'" written by Anchor Games, published in 2001.
Slot Machines, A Pictorial History of the First 100 Years, 5th ed., written by Marshall Fey, published in 1983, p. 17.
Slots 2003, written by Melissa Raimondi, published in Jan. 2003.
Wheel & Deal Brochure, written by Anchor Games, published in Strictly Slots Dec. 2001.
Wheel of Fortune Advertisement, written by IGT, published in 1999.
Wheel of Fortune Game Machine description, written by IGT, published in 1998.
Wheel of Fortune Video Slots Advertisement, written by IGT, published in 2002.
"Wheel Poker," written by Anchor Games/Bally Gaming, published in Strictly Slots Sep. 2002.

* cited by examiner

GAMING DEVICE HAVING A MASKED AWARD GAME

COPYRIGHT NOTICE

A portion of the disclosure of this patent document contains or may contain material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device having a masked award game.

BACKGROUND OF THE INVENTION

Gaming devices, such as slot machines, having primary and secondary or bonus games or schemes are well known. One well known bonus game provides a player with a series of potential awards consisting of credits or dollars. For example, in U.S. Pat. No. 6,102,798, the processor of the gaming device or the player selects a segment from a grid of player selectable segments. The selected segments reveals whether or not a prize value is associated with that segment.

Another known game is Hasbro, Inc. board game "Battleship." This game consists of a two players each receiving an identical pegboard and a plurality of ships. The provided plurality of ships consists of a fleet of ships of various sizes, each ship with a plurality of pegs that engage the pegboard. Each player arranges their ships around their respective pegboard. The game proceeds with each player attempting to determine the location of the other players ships on the pegboard. By selecting and announcing a specific location on the pegboard, each player attempts to discover the arrangement of the other player's ships on the pegboard. If the announced location corresponds with at least one of the pegs of the other player's ships, it's a "hit". An opponent's ship is eliminated or "sunk" by selecting the location of all the pegs on which the ship sits. The first player to eliminate all the opposing players ships wins the game.

Furthermore, U.S. Pat. No. 6,309,299 discloses of a gaming device with a video display configured as a matrix upon which scores can accumulate. Specifically, U.S. Pat. No. 6,309,299 provides a grid with icons located on the grid itself. The gaming device selects one of the segments on the grid and if the gaming device selected location is associated with an icon, the player is awarded a bonus score. In another embodiment of U.S. Pat. No. 6,309,299, the icons are obscured and a player attempts to locate the obscured icons on the grid. If the player successfully reveals an obscured icon, the player is awarded a score for the revealed icon. A shortcoming of U.S. Pat. No. 6,309,299 is that it does not allow the gaming device to select locations of obscured icons on the grid. Additionally, U.S. Pat. No. 6,309,299 does not a allow a combination of the gaming device and the player to select locations of obscured icons on the grid. There is a need for new and different gaming devices related to this type of masked award game.

SUMMARY OF THE INVENTION

The present invention provides a gaming device having a game with masked awards associated with segments of a grid. The game of the present invention may be provided in a primary or base game or a secondary or bonus game. The present invention is discussed and illustrated primarily with respect to a two dimensional grid, however it should be appreciated that a three dimensional grid may be employed in accordance with the present invention. In one embodiment of the present invention, upon the initiation of the game, the gaming device randomly associates a plurality of awards, such as a credit amount, a dollar amount or a modifier, with a plurality of segments of a grid. The associated awards are not initially revealed to the player. It should be appreciated that in one preferred embodiment, the number of awards are less than the number of segments of the grid resulting in a plurality of grid segments, each with no associated award. The gaming device provides a player with a number of opportunities to select segments of the grid by independently indicating both a first or horizontal coordinate and a second or vertical coordinate. It should be appreciated that the coordinates may be other than horizontal and vertical in accordance with the present invention. The number of opportunities may be predetermined, randomly determined or determined during the play of, for example, a base game. The processor of the gaming device reveals the award, if any, associated with the player selected grid segment. If no award is associated with the selected grid segment, the processor of the gaming device will reveal a 'miss' or other no award indication. It should be appreciated that the no award or 'miss' indication associated with a player selected grid segment remains revealed for subsequent player grid segment selections. When the player has no remaining opportunities to select grid segments, the game ends and the player obtains an award based on any revealed awards.

In an alternative embodiment, the player independently selects the first or horizontal coordinate of the grid segment to be revealed and the processor of the gaming device randomly selects the second or vertical coordinate. Alternatively, the player independently selects the vertical coordinate of the grid segment to be revealed and the processor of the gaming device randomly selects the horizontal coordinate. In another embodiment, the gaming device randomly, but independently, selects each of the first and second or vertical and horizontal coordinates of the grid segment to be revealed.

In an alternative embodiment of the present invention, after the gaming device has revealed the award, if any, associated with a segment of the grid, the processor of the gaming device may independently change either the first or horizontal coordinate, the second or vertical coordinate or both coordinates of the player fully or partially selected grid segment. The modified grid segment corresponding to the changed coordinate(s) replaces the player's initial selected segment. This would result in the player no longer obtaining the initial revealed award, if any, associated with the previously revealed segment, but rather the player obtaining the award, if any, associated with the revealed modified grid segment. Alternatively, the player may obtain both awards, if any, the higher award or the lower award. In an alternative embodiment, the processor of the gaming device may change the coordinates of a player selected grid segment a number of times. In a further alternative embodiment, each award associated with a selected grid segment is offered to the player. The player may accept the award and end the game or may reject the award in hope of achieving a higher award associated with another grid segment. In one such embodiment, after a plurality of changes to the offered awards, a final award is provided to the player. The awards offered to the player may be determined using any of the alternative embodiments set forth herein. Thus, it should be appreciated that the present invention may be employed in an offer/acceptance type primary or secondary game of a wagering gaming device.

In an alternative embodiment, a plurality of usable symbols are associated with a plurality of awards. In this embodiment, each usable symbol may be associated with more than one grid segment. This embodiment proceeds as described above, however a player may obtain an award only from a completely revealed usable symbol. This embodiment allows the player to partially reveal a usable symbol and not obtain the award associated with the usable symbol until the usable symbol is completely revealed. It should be appreciated that in one such embodiment, if the player has no remaining opportunities to select grid segments, the player will not obtain any award for any partially revealed usable symbols.

In an alternative embodiment of the present invention, a plurality of first or horizontal coordinates and a plurality of second or vertical coordinates are associated with a masked value, such as a credit or dollar amount. Additionally, a plurality of grid segments are associated with an award, such as a modifier. The value, if any, associated with each horizontal and each vertical coordinate is not initially displayed to the player. Upon the initiation of the game, the gaming device prompts the player to independently select each of a horizontal and a vertical coordinate that corresponds to a grid segment. Once selected, the gaming device reveals the award associated with the selected grid segment. The gaming device also reveals the values, if any, associated with the selected horizontal and vertical coordinates. The player's award, if any, is a combination of the value associated with the selected horizontal coordinate, the value associated with the selected vertical coordinate and the revealed award associated with the selected grid segment.

It is therefore an advantage of the present invention to provide a gaming device with a masked award game.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1A:
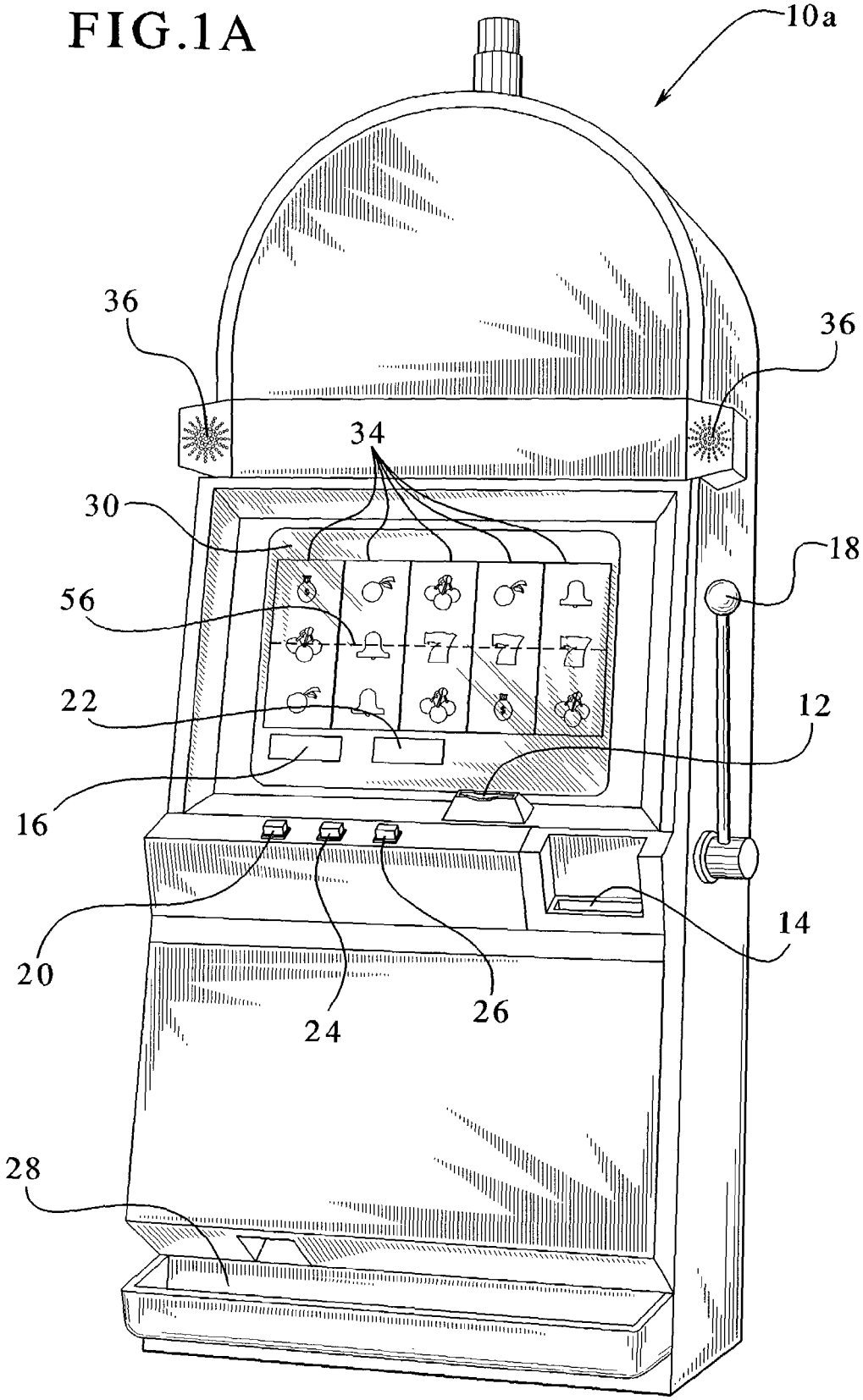
FIGS. 1A and 1B are perspective views of alternative embodiments of the gaming device of the present invention.
Figure 1B:
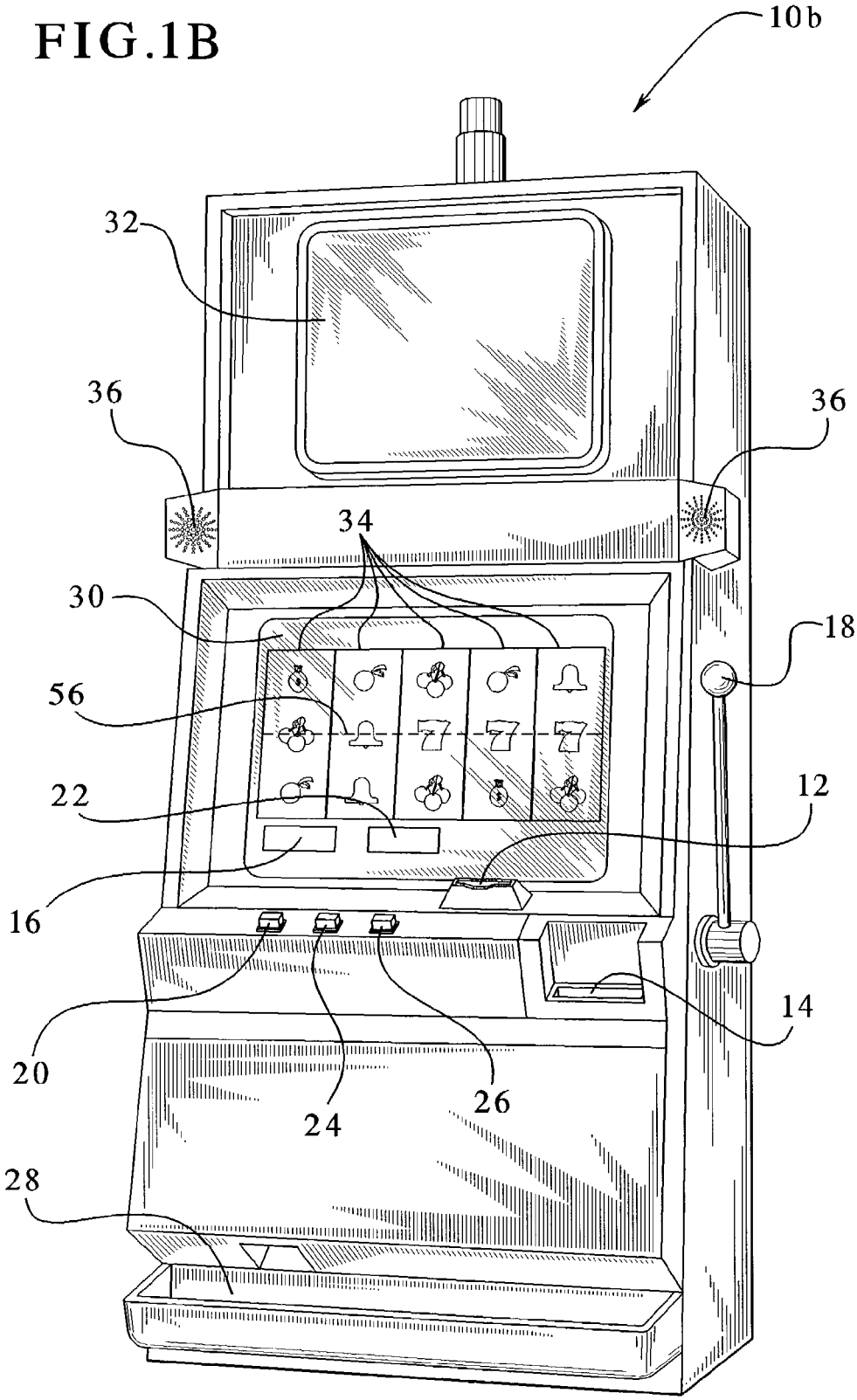

Referring now to the drawings, two embodiments of the gaming device of the present invention are illustrated in FIGS. 1A and 1B as gaming device 10*a* and gaming device 10*b*, respectively. Gaming device 10*a* and/or gaming device 10*b* are generally referred to herein as gaming device 10. Gaming device 10 is preferably a slot machine having the controls, displays and features of a conventional slot machine. It is constructed so that a player can operate it while standing or sitting, and gaming device 10 is preferably mounted on a console. However, it should be appreciated that gaming device 10 can be constructed as a pub-style table-top game (not shown) which a player can operate preferably while sitting. Furthermore, gaming device 10 can be constructed with varying cabinet and display designs, as illustrated by the designs shown in FIGS. 1A and 1B. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any primary game such as slot, poker, blackjack or keno, any of their bonus triggering events and any of their bonus round games. The symbols and indicia used on and in gaming device 10 may be in mechanical, electrical or video form.

As illustrated in FIGS. 1A and 1B, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIGS. 1A and 1B, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

A player may cash out and thereby receive a number of coins corresponding to the number of remaining credits by pushing a cash out button 26. When the player cashes out, the player receives the coins in a coin payout tray 28. The gaming device 10 may employ other payout mechanisms such as credit slips redeemable by a cashier or electronically recordable cards which keep track of the player's credits.

Gaming device 10 also includes one or more display devices. The embodiment shown in FIG. 1A includes a central display device 30, and the alternative embodiment shown in FIG. 1B includes a central display device 30 as well as an upper display device 32. Gaming device 10 preferably displays a plurality of reels 34, preferably three to five reels 34 in mechanical or video form at one or more of the display devices. A display device can be any viewing surface such as glass, a video monitor or screen, a liquid crystal display or any other display mechanism. If the reels 34 are in video form, the display device for the video reels 34 is preferably a video monitor.

Each reel 34 displays a plurality of indicia such as bells, hearts, fruits, numbers, letters, bars or other images which preferably correspond to a theme associated with the gaming device 10. Furthermore, gaming device 10 preferably includes speakers 36 for making sounds or playing music.

Figure 2:
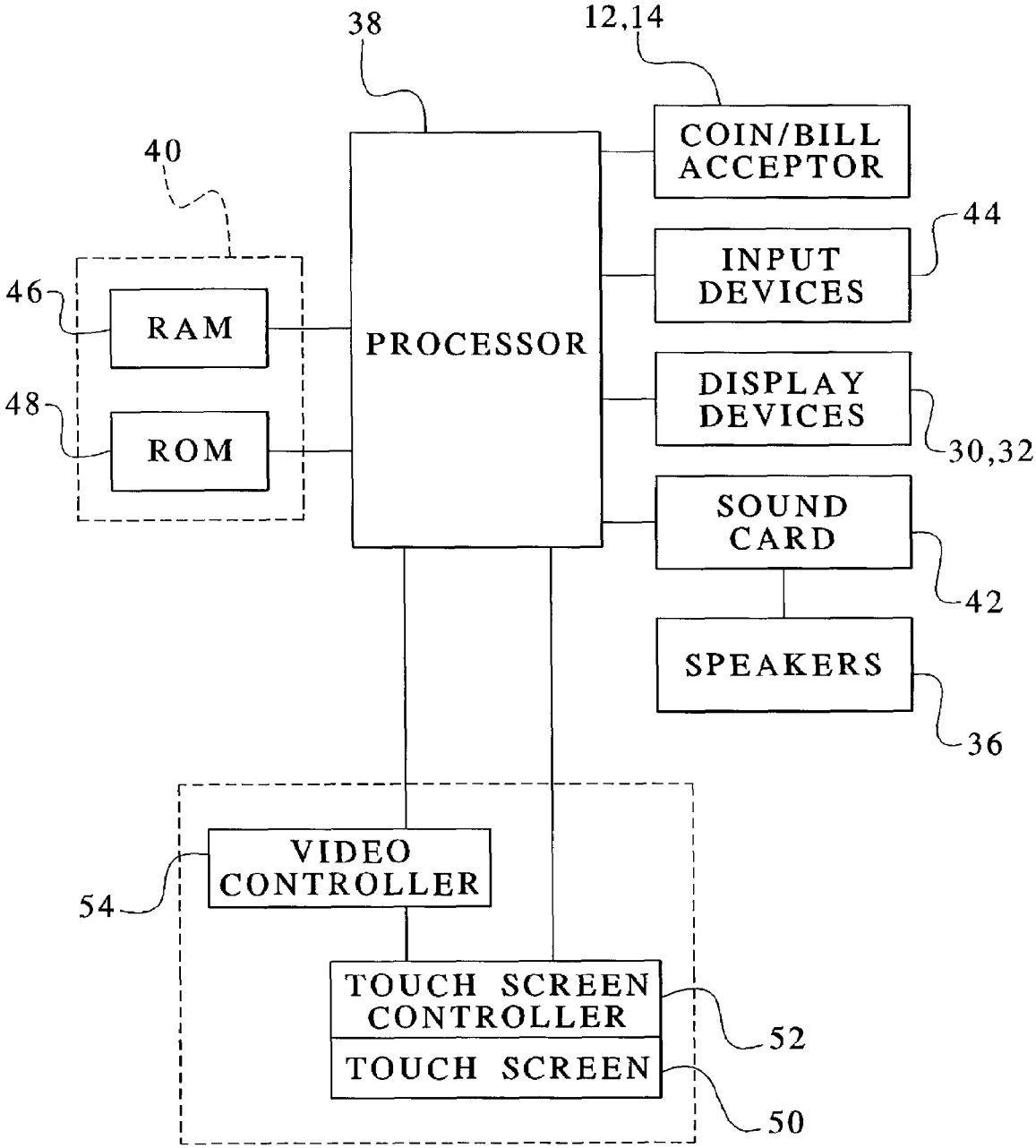
FIG. 2 is a schematic block diagram of the electronic configuration of one embodiment of the gaming device of the present invention.

As illustrated in FIG. 2, the general electronic configuration of gaming device 10 preferably includes: a processor 38; a memory device 40 for storing program code or other data; a central display device 30; an upper display device 32; a sound card 42; a plurality of speakers 36; and one or more input devices 44. The processor 38 is preferably a microprocessor or microcontroller-based platform which is capable of displaying images, symbols and other indicia such as images of people, characters, places, things and faces of cards. The memory device 40 can include random access memory (RAM) 46 for storing event data or other data generated or used during a particular game. The memory device 40 can also include read only memory (ROM) 48 for storing program code which controls the gaming device 10 so that it plays a particular game in accordance with applicable game rules and pay tables.

As illustrated in FIG. 2, the player preferably uses the input devices 44, such as pull arm 18, play button 20, the bet one button 24 and the cash out button 26 to input signals into gaming device 10. In certain instances it is preferable to use a touch screen 50 and an associated touch screen controller 52 instead of a conventional video monitor display device. Touch screen 50 and touch screen controller 52 are connected to a video controller 54 and processor 38. A player can make decisions and input signals into the gaming device 10 by touching touch screen 50 at the appropriate places. As further illustrated in FIG. 2, the processor 38 can be connected to coin slot 12 or bill acceptor 14. The processor 38 can be programmed to require a player to deposit a certain amount of money in order to start the game.

It should be appreciated that although a processor 38 and memory device 40 are preferable implementations of the present invention, the present invention can also be implemented using one or more application-specific integrated circuits (ASIC's) or other hard-wired devices, or using mechanical devices (collectively and/or alternatively referred to herein as a "processor"). Furthermore, although the processor 38 and memory device 40 preferably reside on each gaming device 10 unit, it is possible to provide some or all of their functions at a central location such as a network server for communication to a playing station such as over a local area network (LAN), wide area network (WAN), Internet connection, microwave link, and the like. The processor 38 and memory device 40 is generally referred to herein as the computer or controller.

With reference to FIGS. 1A, 1B and 2, to operate the gaming device 10 in one embodiment the player must insert the appropriate amount of money or tokens at coin slot 12 or bill acceptor 14 and then pull the arm 18 or push the play button 20. The reels 34 will then begin to spin. Eventually, the reels 34 will come to a stop. As long as the player has credits remaining, the player can spin the reels 34 again. Depending upon where the reels 34 stop, the player may or may not win additional credits.

In addition to winning credits in this manner, preferably gaming device 10 also gives players the opportunity to win credits in a bonus round. This type of gaming device 10 will include a program which will automatically begin a bonus round when the player has achieved a qualifying condition in the game. This qualifying condition can be a particular arrangement of indicia on a display device. The gaming device 10 preferably uses a video-based central display device 30 to enable the player to play the bonus round. Preferably, the qualifying condition is a predetermined combination of indicia appearing on a plurality of reels 34. As illustrated in the five reel slot game shown in FIGS. 1A and 1B, the qualifying condition could be the number seven appearing on three adjacent reels 34 along a payline 56. It should be appreciated that the present invention can include one or more paylines displayed in a horizontal and/or diagonal fashion.

Masked Award Game

Referring generally to FIGS. 3A to 3E, one embodiment of the masked award game of the present invention provides a screen or display which displays a plurality of segments of a grid. The present invention is discussed and illustrated primarily with a grid composed of six independently selectable first or horizontal and six independently selectable second or vertical coordinates; however, it should be appreciated that any suitable number of each coordinate may be employed in accordance with the present invention. Each segment has a corresponding horizontal and vertical independently selectable coordinate that indicates its relative position on the grid. The screen or display is preferably a touch screen, which in certain embodiments enables the player to select a grid segment to obtain an award. The screen displays a plurality of segments of the grid. The gaming device preferably provides a plurality of awards, such as a credit amount, a dollar amount, one or more free games, or a modifier, which are randomly associated with a plurality of segments of the grid. Each grid segment preferably does not initially display the award, if any, associated with the grid segment. Alternatively, a plurality of grid segments may be associated with additional player opportunities to select grid segments, usable symbols associated with awards or any combination thereof. It should be appreciated that in one embodiment, there are more grid segments than awards. Thus, a plurality of segments of the grid will each have no associated award. In alternative embodiments, there are less grid segments than awards or the same number of grid segments and awards.

The gaming device may randomly select the award associated with each grid segment from a pre-determined pool of award. Alternatively, the gaming device may have multiple pre-determined pools of awards. Alternatively, the gaming device may randomly select awards from a pre-determined range of awards. The awards associated with any grid segment are preferably randomly determined each time the game is triggered.

At the onset of the game, the gaming device determines the number of opportunities the player will have to select segments of the grid. It should be appreciated that the number of opportunities may be randomly determined, predetermined or determined otherwise such as in a primary game if the game of the present invention is employed as a secondary game. For example, the number of opportunities may be related to the player's wager during the primary game. For increased entertainment, the number of remaining opportunities to select grid segments may not be revealed to the player. Each time the player selects a grid segment, the number of opportunities to select a grid segment is decreased by one.

Upon the triggering of the game, in one embodiment, the gaming device prompts the player to select a grid segment by independently inputting a first or horizontal coordinate and a second or vertical coordinate. The processor of the gaming device reveals the award, if any, associated with the player selected grid segment. If no award is associated with the selected grid segment, the processor of the gaming device will reveal a 'miss' or other no award indication. It should be appreciated that the no award or 'miss' indication associated with a player selected grid segment remains revealed for subsequent player grid segment selections. When the player has no remaining opportunities to select grid segments, the game ends and the player obtains a combination of any revealed awards. A display device displays to the player any award obtained as well as the number of remaining opportunities to select segments of the grid remaining. In an alternative embodiment (not shown), after the player has obtained an award, the gaming device reveals the awards associated with the non-selected grid segments. This provides increased entertainment to the player by revealing all the potential awards the player could have obtained during the game.

Figure 3A:
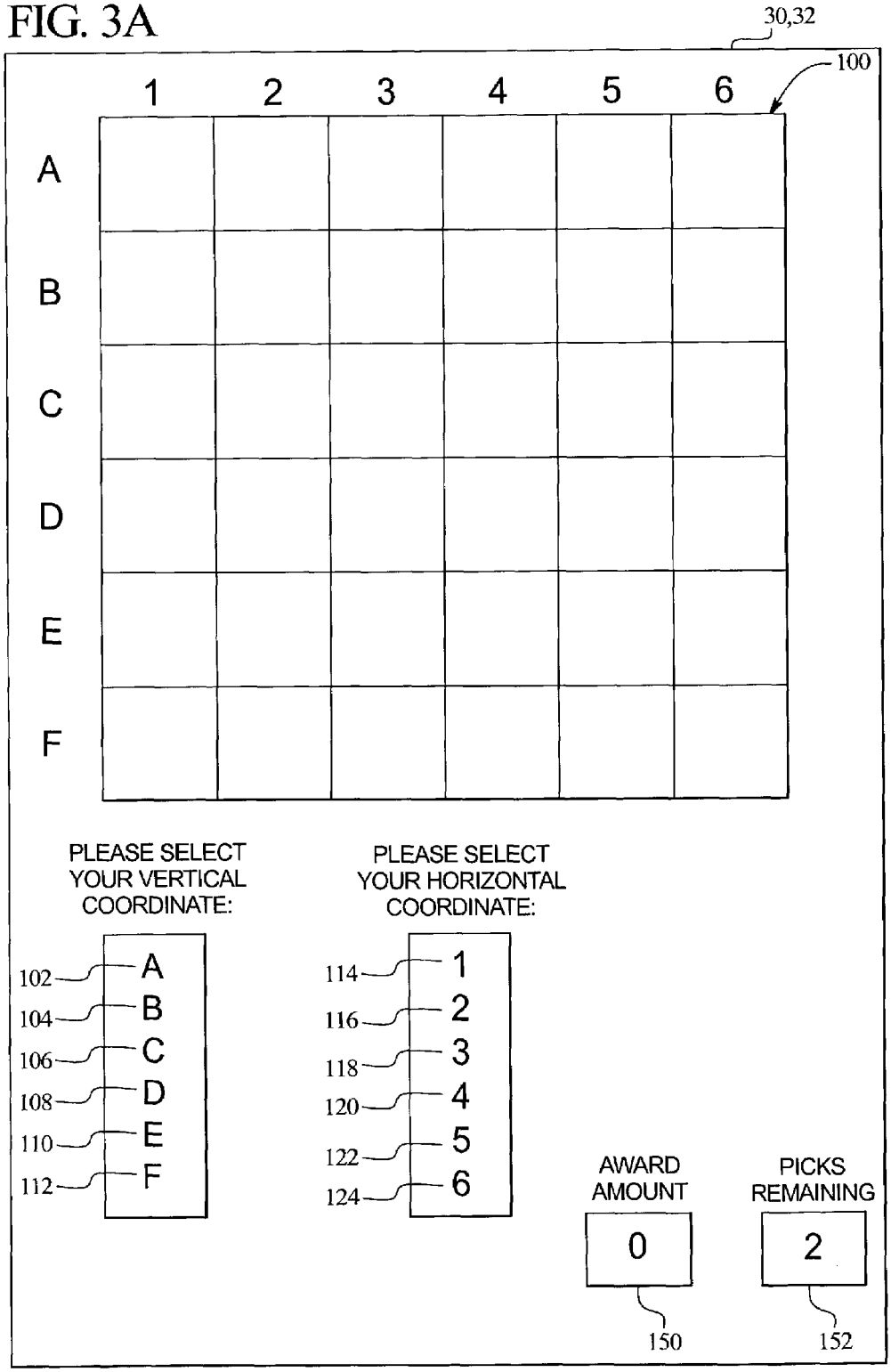
FIGS. 3A to 3E are front elevational views of a grid of one embodiment of the present invention illustrating the player selected grid segments revealing an associated award.
Figure 3B:
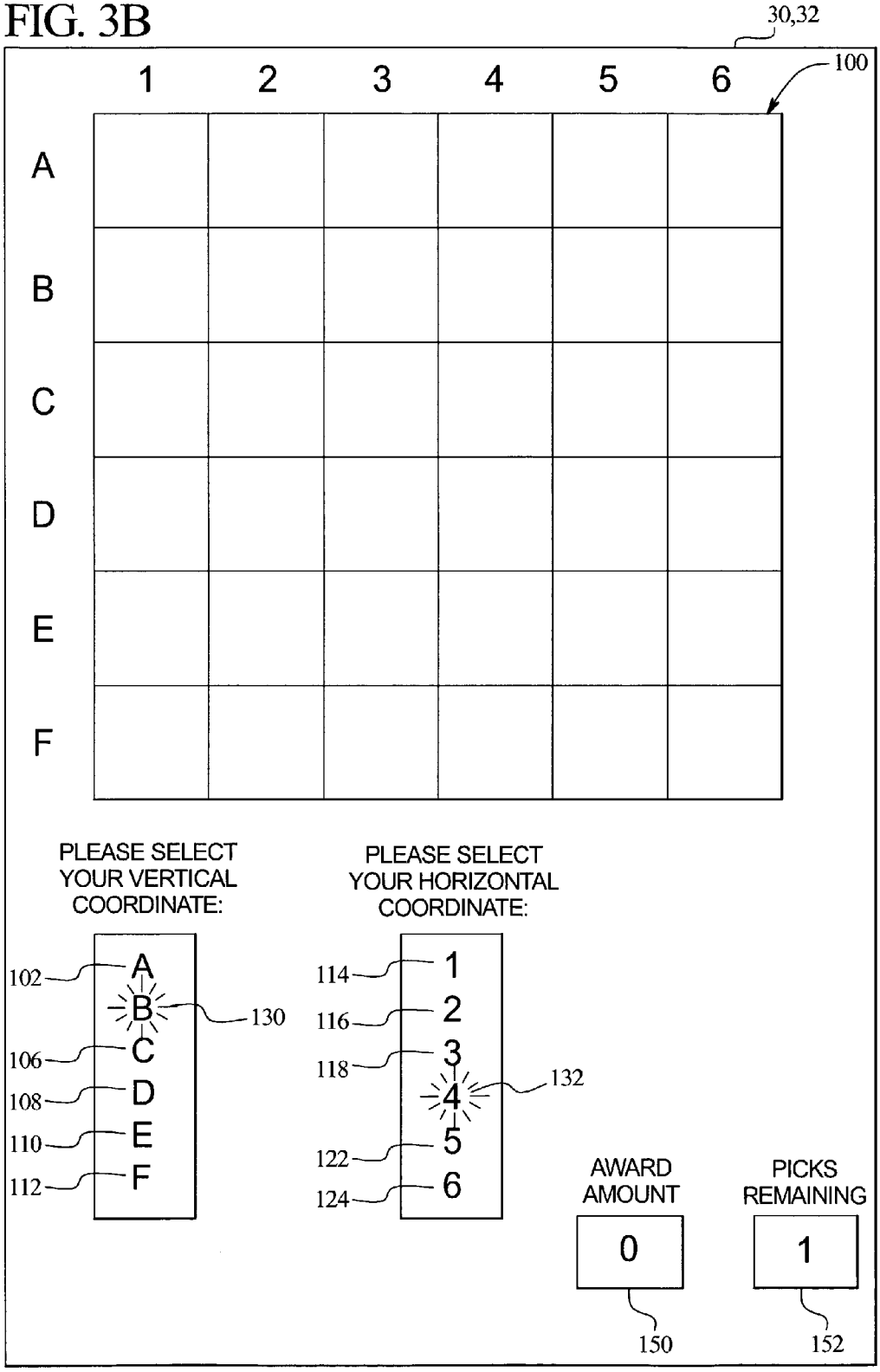
Figure 3C:
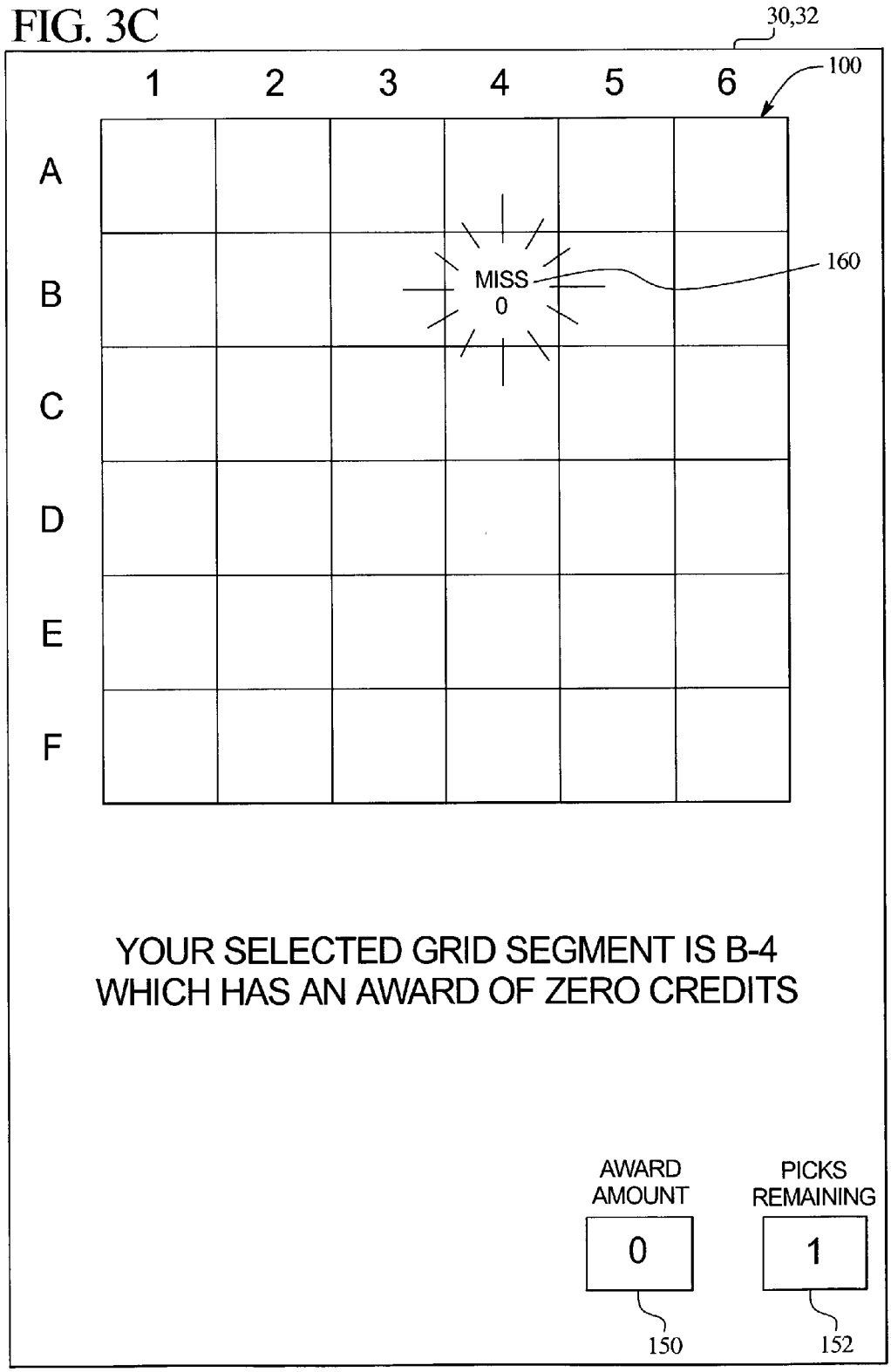

Referring to FIG. 3A, the gaming device provides a segmented grid 100. Upon the initiation of the game, the gaming device provides the player a number of opportunities to select grid segments. In this case, the gaming device provided the player two opportunities, displayed in the picks remaining display 152. In this embodiment, there are six independently selectable vertical coordinates 102, 104, 106, 108, 110, and 112 labeled A, B, C, D, E and F, respectively. The are also six independently selectable horizontal coordinates 114, 116, 118, 120, 122 and 124 labeled 1, 2, 3, 4, 5 and 6, respectively. The gaming device prompts the player to select a grid segment by independently selecting one vertical coordinate and one horizontal coordinate. As seen in FIG. 3B, the player selected grid segment B-4 by individually and independently selecting highlighted vertical coordinate B numbered 130 and highlighted horizontal coordinate 4 numbered 132. The gaming device subsequently reveals the award, if any, associated with the player selected grid segment. As revealed in FIG. 3C, selected grid segment B-4 had no associated award as indicated by the highlighted "miss 0" symbol 160. Accordingly, the award amount display 150 displayed an award amount of zero. Appropriate messages such as "PLEASE SELECT YOUR VERTICAL AND HORIZONTAL COORDINATES" and "YOUR SELECTED GRID SEGMENT IS B-4 WHICH HAS AN AWARD OF ZERO CREDITS" are preferably provided to the player visually, or through suitable audio or audiovisual displays.

Figure 3D:
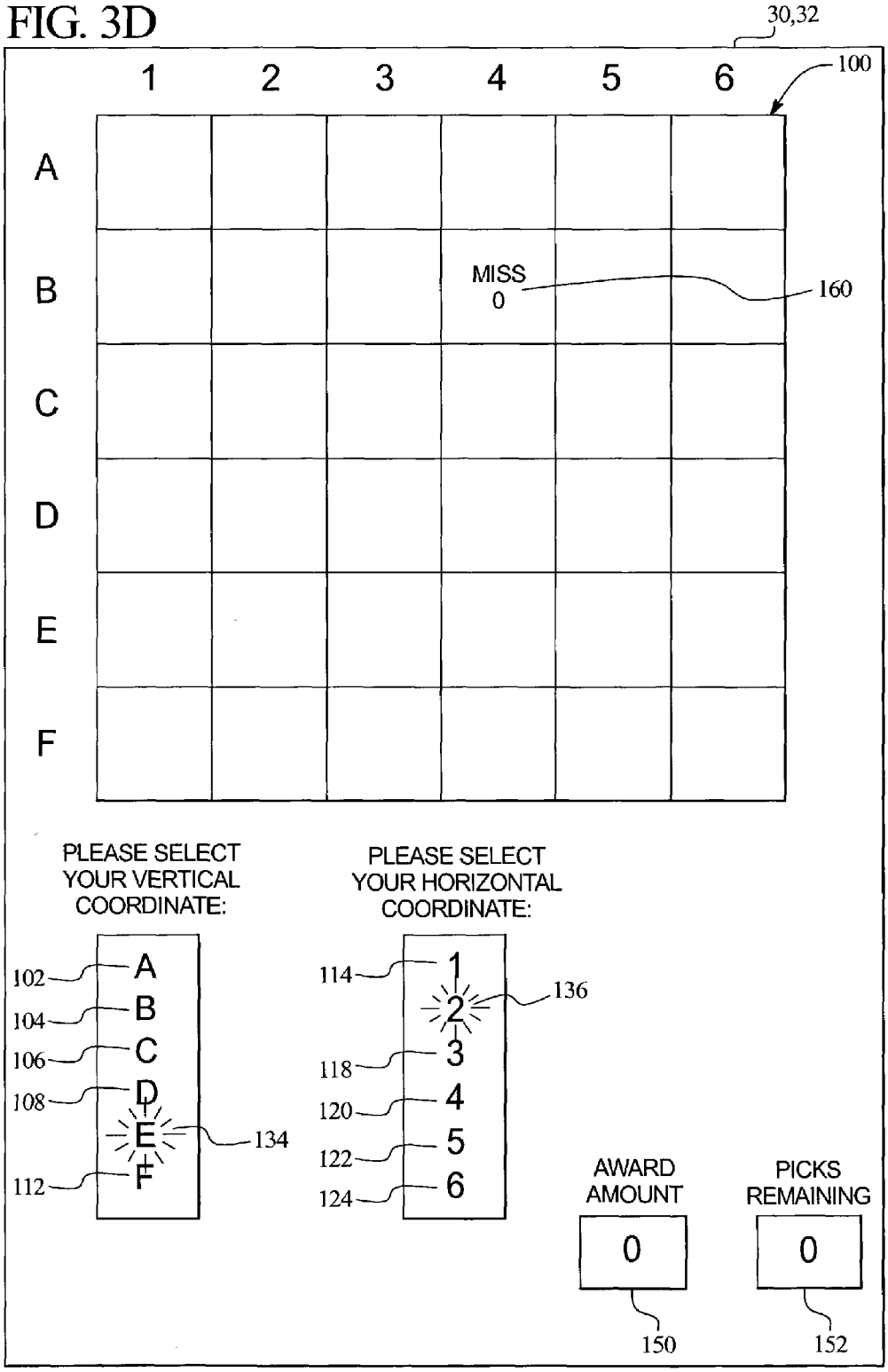
Figure 3E:
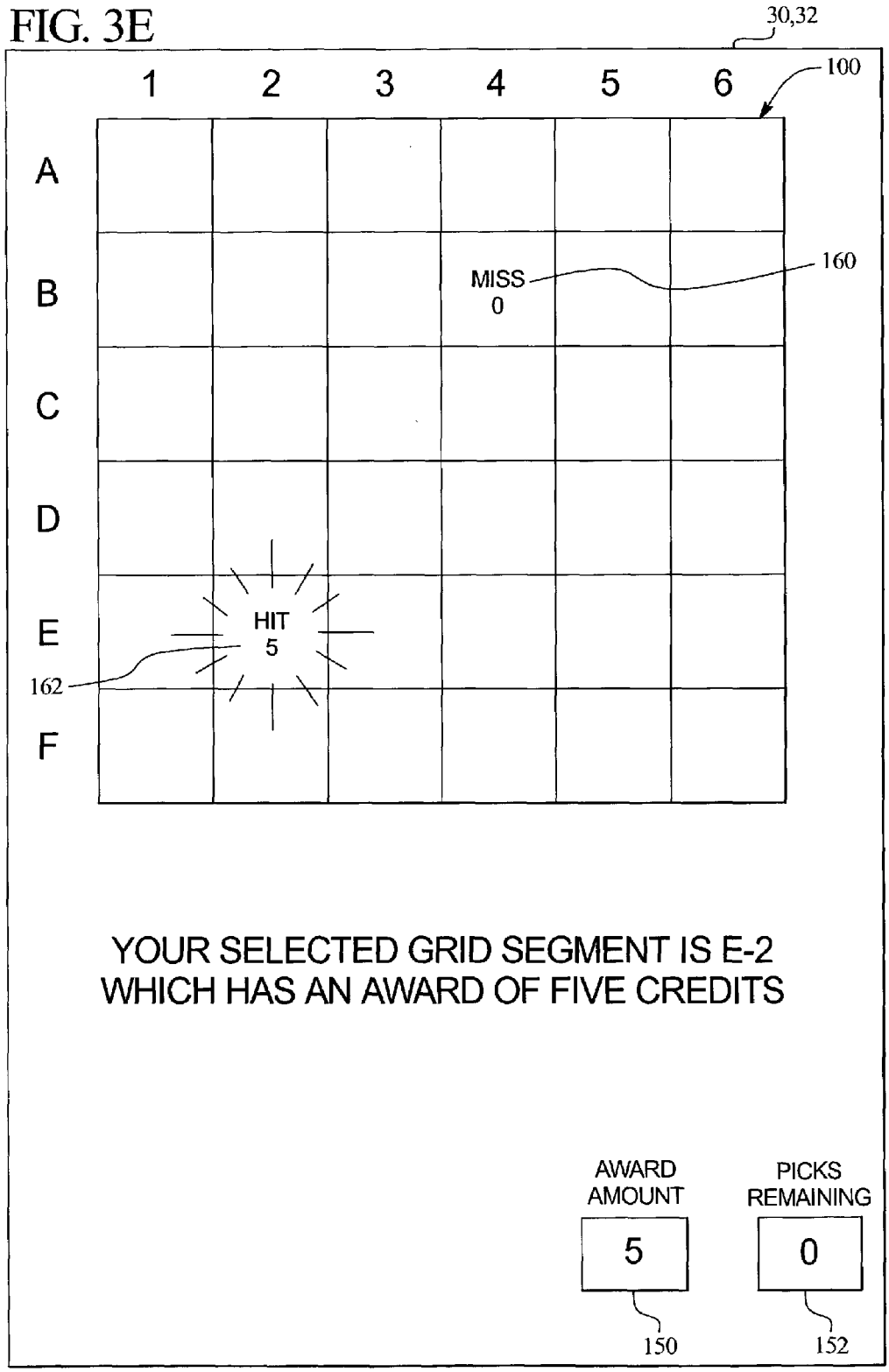

Since the player had at least one pick remaining 152, the gaming device prompts the player to select another grid segment by independently selecting one vertical coordinate and one horizontal coordinate. It should be appreciated that the "miss 0" symbol 160 of revealed grid segment B-4 remains revealed for subsequent player grid segment selections. As seen in FIG. 3D, the player next selected grid segment E-2 by individually and independently selecting highlighted vertical coordinate E numbered 134 and highlighted horizontal coordinate 2 numbered 136. As revealed in FIG. 3E, selected grid segment E-2 had an associated award amount of five credits as indicated by the highlighted "Hit 5" symbol 162. Accordingly, the award amount display 150 displayed the revealed award amount of five. Appropriate messages such as "PLEASE SELECT YOUR VERTICAL AND HORIZONTAL COORDINATES" and "YOUR SELECTED GRID SEGMENT IS E-2 WHICH HAS AN AWARD OF FIVE CREDITS" are preferably provided to the player visually, or through suitable audio or audiovisual displays. With zero picks remaining 152, the player obtains a combination of all the revealed awards, in this case five, and the game ends. In an alternative embodiment of the present invention, the processor randomly associates the values or hits and the non-values or misses with the grid segments or pairs of coordinates after each pair or designated numbers of coordinates is selected by the player.

In an alternative embodiment of the present invention, the player independently selects the first or horizontal coordinate and the processor of the gaming device randomly selects the second or vertical coordinate. Alternatively, the player independently selects the vertical coordinate and the processor of the gaming device randomly selects the horizontal coordinate. Thus, each selection of a grid segment is determined in part by the player and in part randomly by the processor of the gaming device. This embodiment provides increased entertainment to the player because the player has only a partial control in selecting the grid segment that represents their award. In another embodiment, the processor of the gaming device randomly, but independently, selects each of the first and second or vertical and horizontal coordinates of a grid segment. It should be appreciated that during the play of a single game, the processor of the gaming device may independently select the first or horizontal coordinate of one grid segment selection and subsequently independently select the second or vertical coordinate of the following grid segment selection. It should further be appreciated that in one embodiment of the present invention, after the value associated with horizontal and vertical coordinates are revealed, such as "O" for coordinate B4 in FIG. 3C, the player or the processor may change one of the coordinates (such as coordinate "4" to coordinate "2"). The gaming device would then reveal the value associated with the new coordinate. The changing of one coordinate could be allowed by the game one or more consecutive times by the player or randomly by the processor.

Figure 3F:
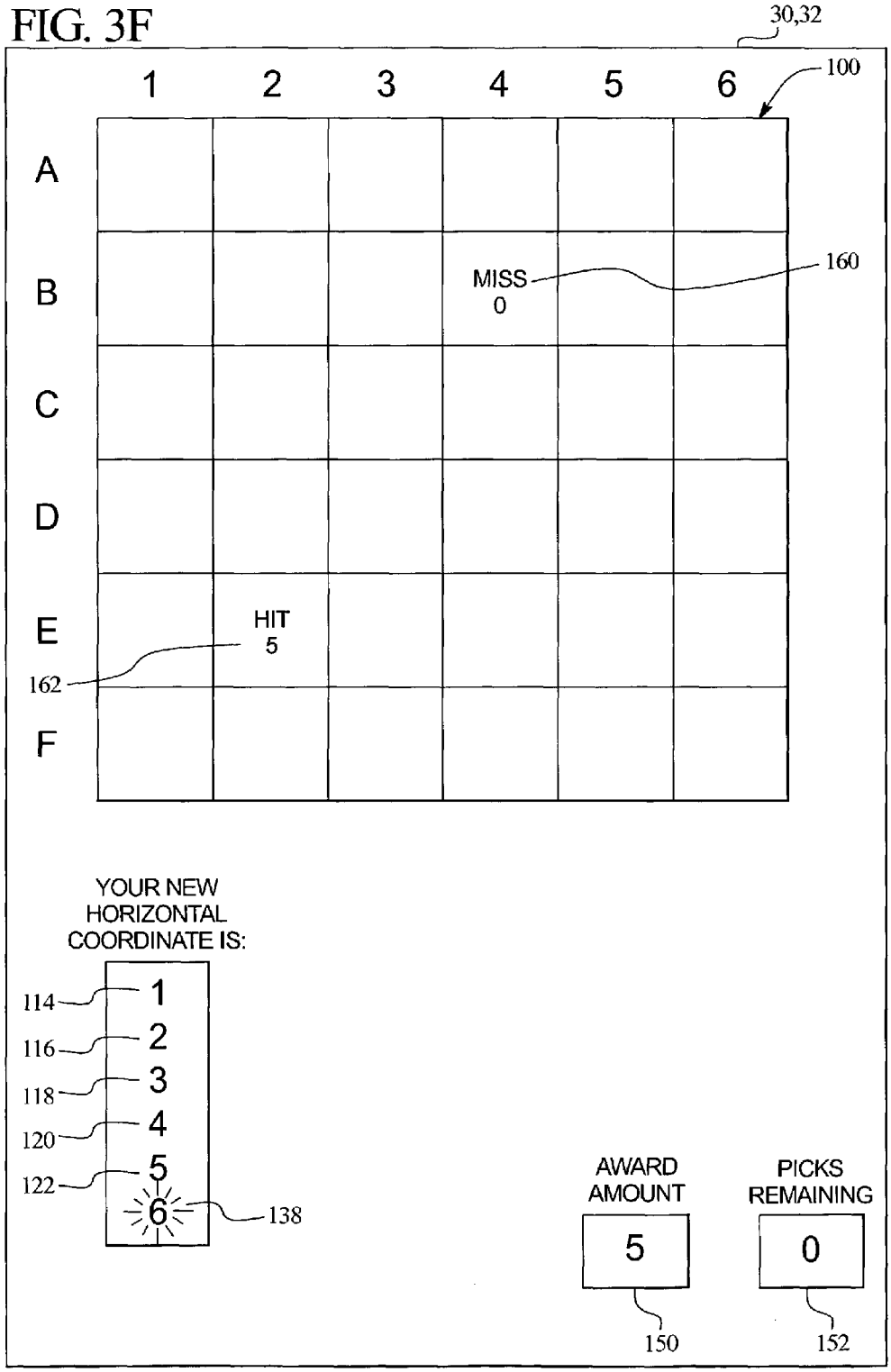
FIGS. 3F to 3G are front elevational views of a grid of an alternative embodiment of the present invention illustrating the gaming device modifying the player selected grid segments.
Figure 3G:
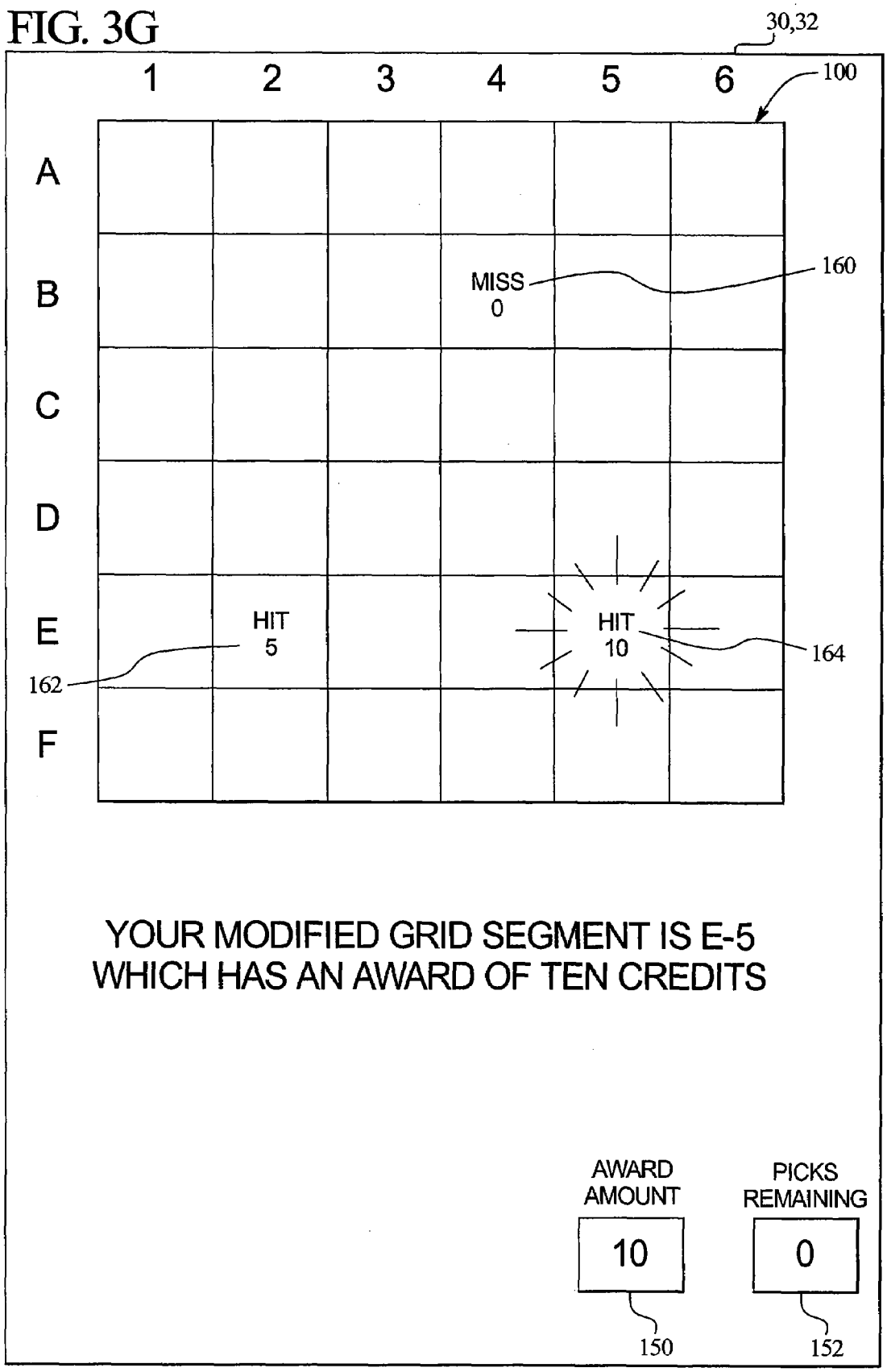

Referring in general to FIGS. 3F and 3G, in an alternative embodiment of the present invention, after the gaming device has revealed the award, if any, associated with a segment of the grid, the processor of the gaming device may independently change either the first or horizontal coordinate, the second or vertical coordinate or both coordinates of the player fully or partially selected grid segment. The modified grid segment corresponding to the changed coordinate(s) replaces the player's initial selected grid segment. This would result in the player no longer obtaining the revealed award, if any, associated with the initial revealed segment, but rather the player obtaining the award, if any, associated with the revealed modified grid segment. Alternatively, the player may obtain both awards, if any, the higher award or the lower award. This embodiment provides increased entertainment to the player because the player is shown the revealed awards that the player might have obtained had the gaming device not intervened and selected another grid segment. In an alternative embodiment, the processor of the gaming device may subsequently independently change the coordinates of the revealed modified grid segment. In another embodiment, each time the processor of the gaming device modifies the player's selected segment with a modified grid segment, the player may accept or reject the award associated with the modified grid segment. The player may be given the accept/reject option before or after the award associated with the modified grid segment is revealed to the player.

As seen in FIG. 3F, after the player independently selected the coordinates for two grid segments (segments B-4 numbered 160 and E-2 numbered 162) that revealed the awards of zero and five, respectively, the processor of the gaming device has randomly, but independently selected new horizontal coordinate 6 numbered 138 as the horizontal coordinate of the player's last selected grid segment. As revealed in FIG. 3G, selected grid segment E-5 had an associated award amount of ten credits as indicated by the highlighted "Hit 10" symbol 164. Accordingly, the award amount display 150 displayed the modified revealed award amount of ten. It should be appreciated that the player may obtain a combination of the award associated with the player selected grid segment and the award associated with the gaming device modified grid segment. Appropriate messages such as "YOUR NEW HORIZONTAL COORDINATE IS 5" and "YOUR MODIFIED GRID SEGMENT IS E-5 WHICH HAS AN AWARD OF TEN CREDITS" are preferably provided to the player visually, or through suitable audio or audiovisual displays.

In an alternative embodiment of the present invention, the game proceeds as described above, however, the processor of the gaming device prompts the player to select a plurality of first horizontal coordinates and a plurality of second or vertical coordinates. The processor of the gaming device randomly, but independently, selects one horizontal and one vertical coordinate from the player selected pluralities of horizontal and vertical coordinates. The processor selected horizontal and vertical coordinates correspond to the grid segment to be revealed. This embodiment provides increased entertainment to the player because the revealed grid segment is determined in part by the player and in part randomly by the processor.

Figure 4A:
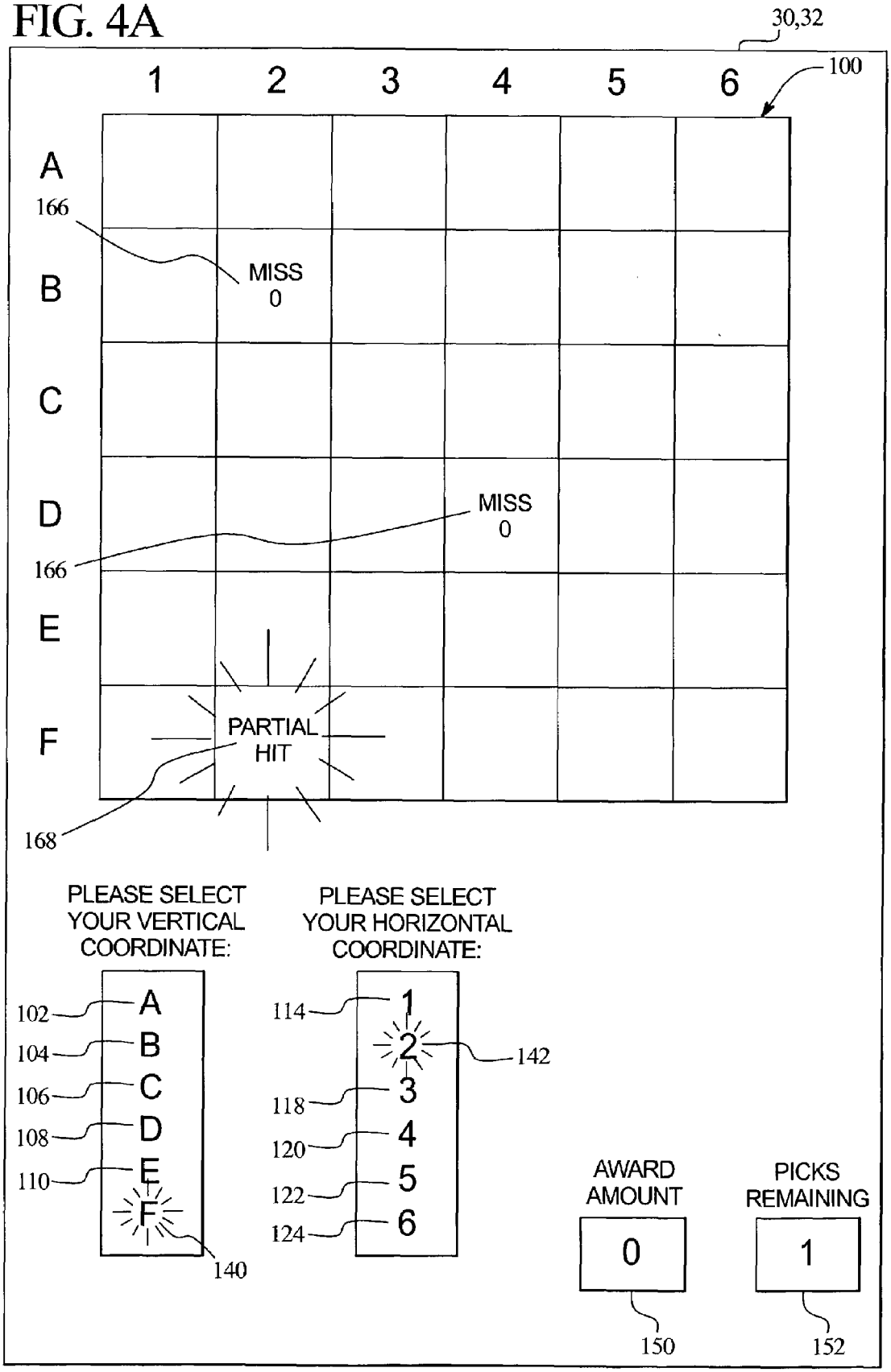
FIGS. 4A and 4B are front elevational views of a grid of an alternative embodiment of the present invention illustrating the gaming device revealing a partial award.
Figure 4B:
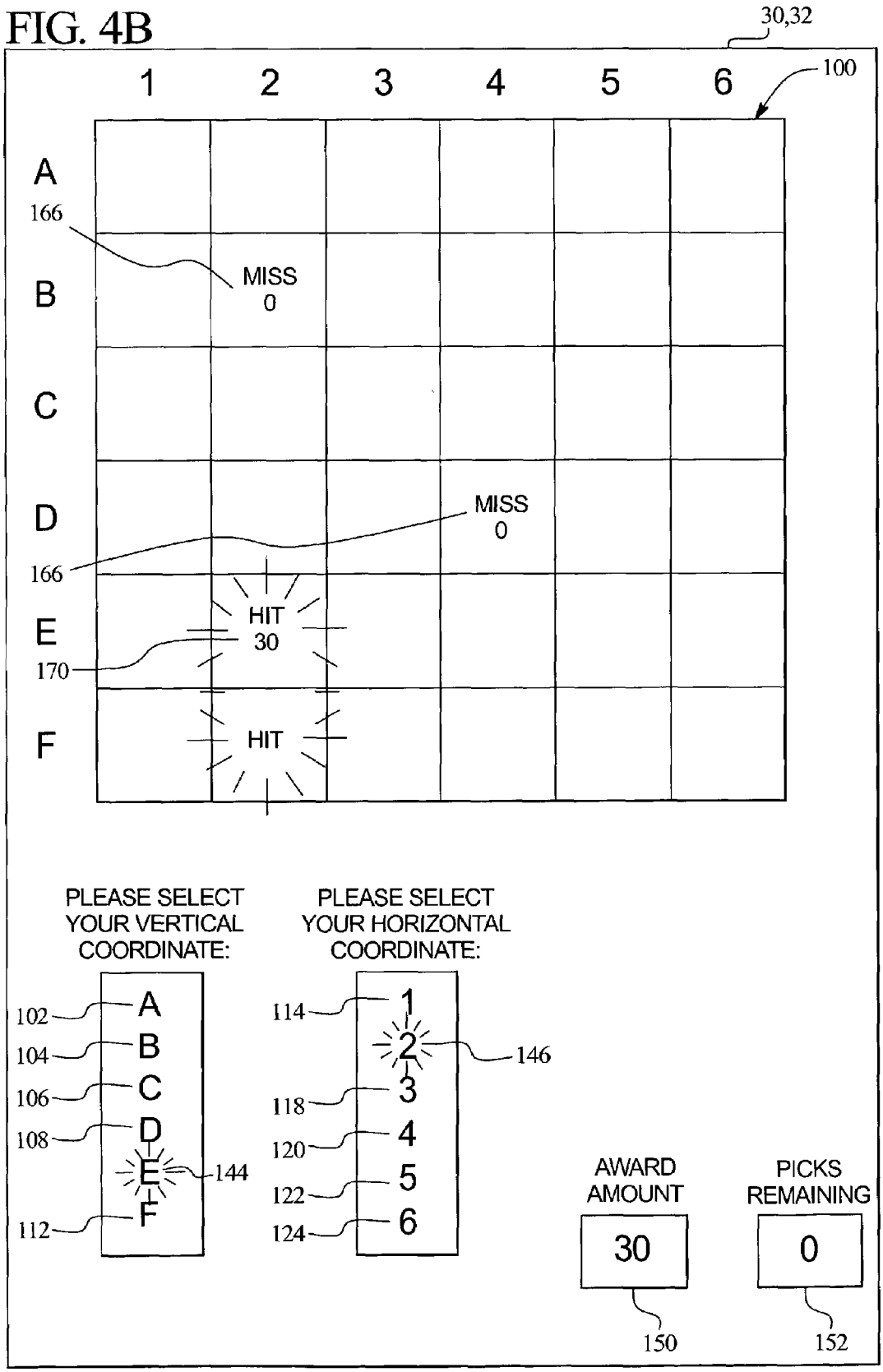

Referring generally to FIGS. 4A and 4B, in an alternative embodiment of the present invention, a plurality of usable symbols are associated with a plurality of segments of the grid. Each usable symbol may be associated with more than one grid segment. In this embodiment, each usable symbol is associated with an award amount or a modifier. The game proceeds as described above, however, if a selected grid segment is associated with a usable symbol that is associated with more than one grid segments, then the player obtains no award until the entire usable symbol is revealed. For increased entertainment, the award amount or modifier associated with each usable symbol may not be revealed to the player until the end of the game. This embodiment may result in the player independently selecting the coordinates of a grid segment only to reveal a partial usable symbol, but with no remaining opportunities to select segments, the player will not obtain any award, resulting in increased excitement and entertainment for the player.

As illustrated in FIG. 4A, after previously selecting two grid segments (segments B-2 numbered 166 and D-4 numbered 166) that revealed no usable symbol, the player next selected grid segment F-2 by individually and independently selecting highlighted vertical coordinate F numbered 140 and highlighted horizontal coordinate 2 numbered 142. As revealed in FIG. 4A, selected grid segment F-2 reveals only a partial usable symbol 168. After revealing a partial usable symbol, the player's next selection would logically be a grid segment adjacent to the partially revealed usable symbol to reveal the entire usable symbol. In this case, as revealed in FIG. 4B, the player next selected grid segment E-2 by individually and independently selecting highlighted vertical coordinate E numbered 144 and highlighted horizontal coordinate 2 numbered 146. The selected grid segment E-2 reveals the other portion of the partially revealed usable symbol in segment E-2. The usable symbol associated with grid segments E-2 and F-2 numbered 170 had an associated award amount of thirty credits, as displayed in the award amount display 150. With zero picks remaining 152 and an entire usable symbol revealed, the player obtains the award associated with the revealed usable symbol and the game ends. It should be appreciated that had the player if zero picks remaining after revealing the partial usable symbol, the game would end with the player receiving no award for any partially revealed usable symbols.

In an alternative embodiment of the present invention, a plurality of first or horizontal coordinates and a plurality of second or vertical coordinates are associated with masked values, such as credit or dollar amounts. Additionally, a plurality of grid segments are each associated with a plurality of awards, such as a modifier. The masked values, if any, associated with each first or horizontal and each second or vertical coordinate are not initially displayed to the player. The awards, if any, associated with each grid segment are not initially displayed to the player. Upon the initiation of the game, the gaming device prompts the player to independently select a first or horizontal and a second or vertical coordinate that corresponds to a grid segment. Once selected, the gaming device reveals the award, if any, associated with the selected grid segment. The gaming device also reveals the masked values, if any, associated with the independently selected horizontal and vertical coordinates. In an alternative embodiment, the gaming device reveals the awards associated with each horizontal coordinate, each vertical coordinate and each grid segment. The player's award, if any, is based on or a combination of the value associated with the independently selected horizontal coordinate, the value associated with the independently selected vertical coordinate and the revealed award associated with the selected grid segment.

Figure 5A:
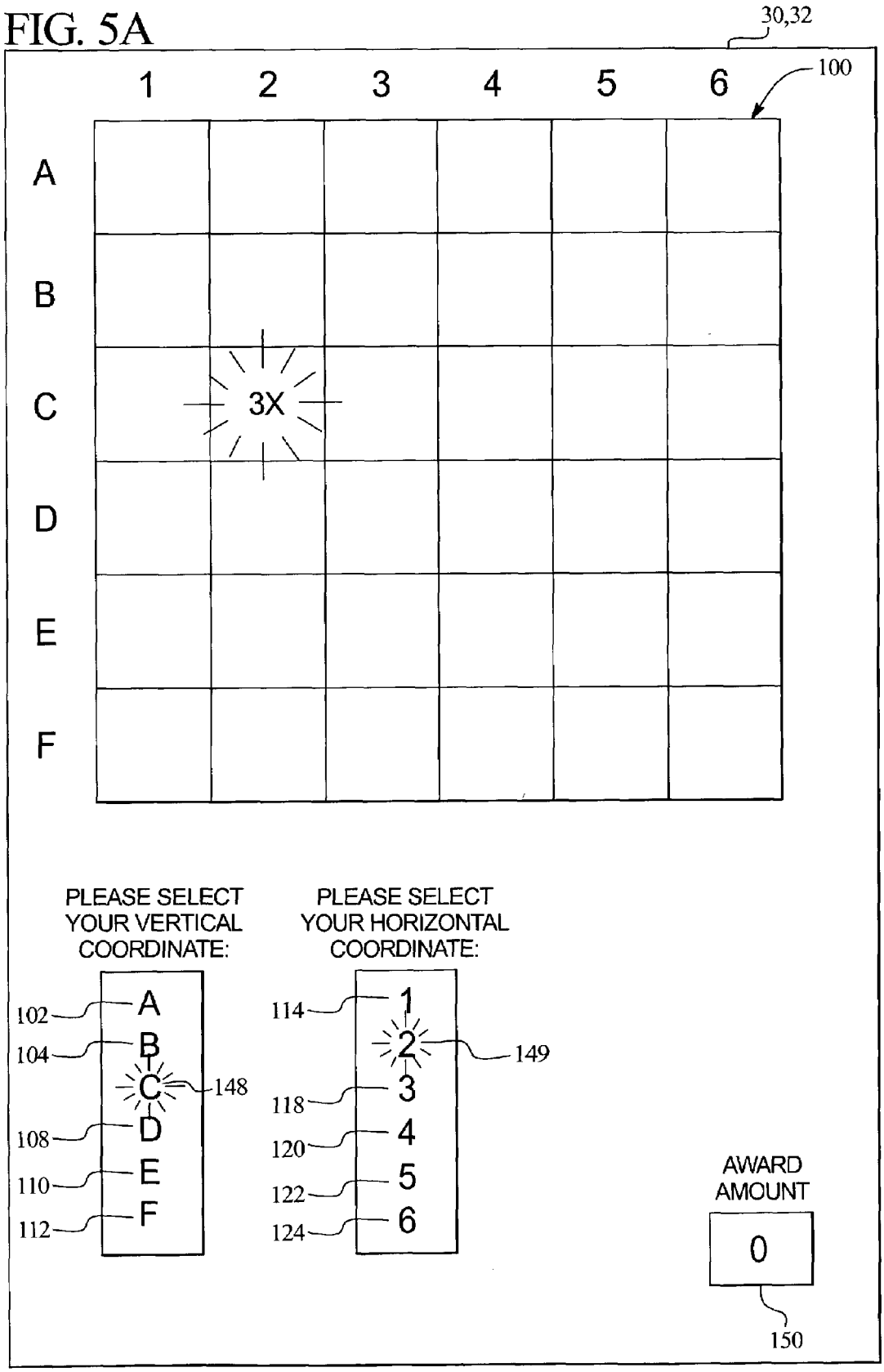
FIGS. 5A and 5B are front elevational views of a grid of an alternative embodiment of the present invention illustrating the gaming device revealing awards associated with the coordinates of the grid.
Figure 5B:
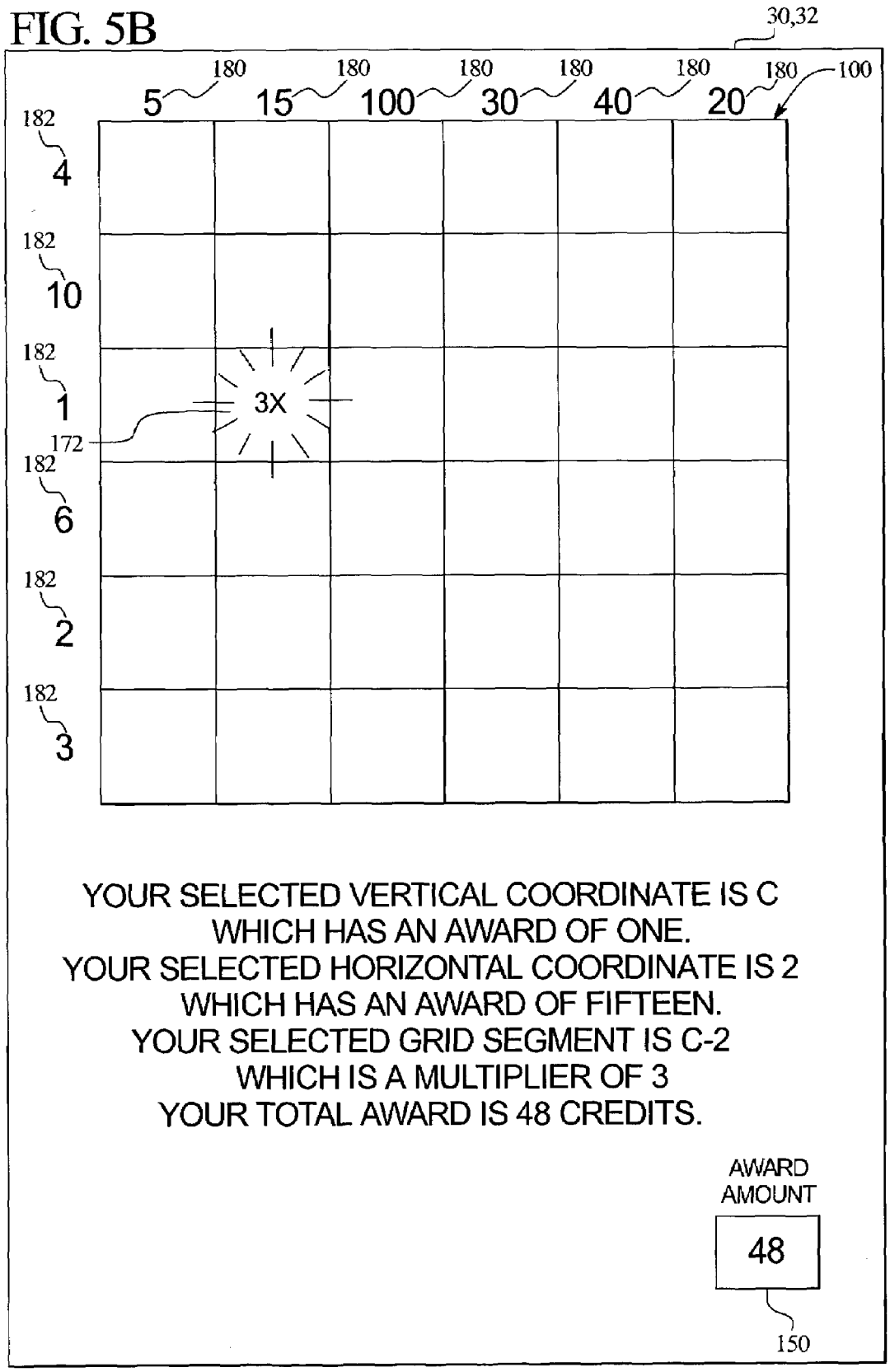

As illustrated in FIG. 5A, the player had already independently selected their horizontal and vertical coordinates. In this case, the player individually and independently selected highlighted vertical coordinate C numbered 148 and highlighted horizontal coordinate 2 numbered 149. As shown in FIG. 5A, the processor of the gaming device revealed the selected grid segment C-2 which had an associated modifier of 3× numbered 172. As revealed in FIG. 5B, the processor of the gaming device revealed the award amounts associated with each horizontal coordinate 180 and each vertical coordinate 182. With zero picks remaining 152, the player obtains an award of forty-eight credits. The player's award is a combination of one 182 (the value assigned to independently selected vertical coordinate C)

plus fifteen 180 (the value assigned to independently selected horizontal coordinate 2) multiplied by three (the revealed modifier associated with grid segment C-2) as displayed in the award amount display 150.

Figure 6A:
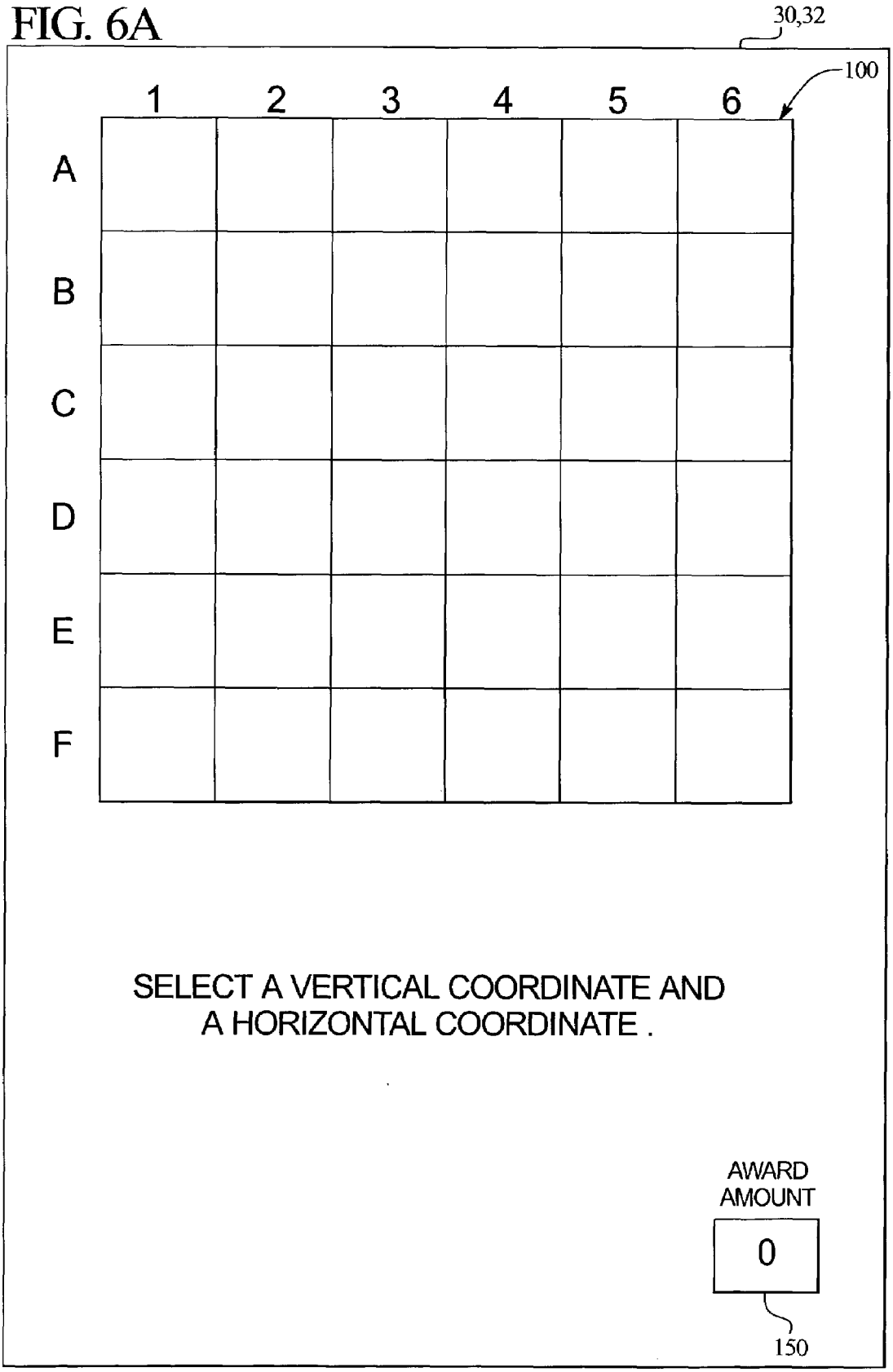
FIGS. 6A to 6D are front elevational views of a grid of an alternative embodiment of the present invention illustrating values associated with the coordinates and a modifier such as a multiplier associated with the grid segments.
Figure 6B:
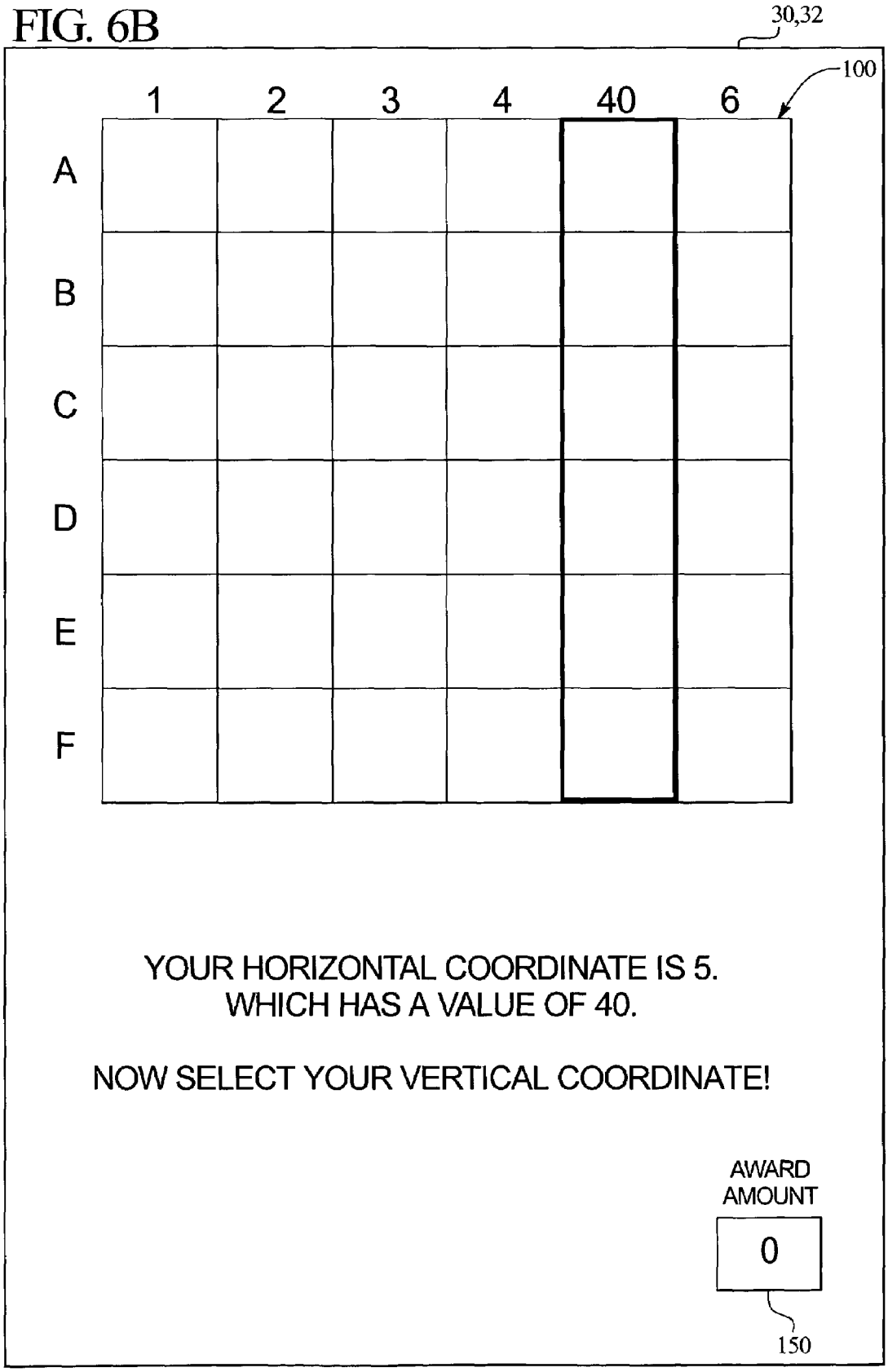
Figure 6C:
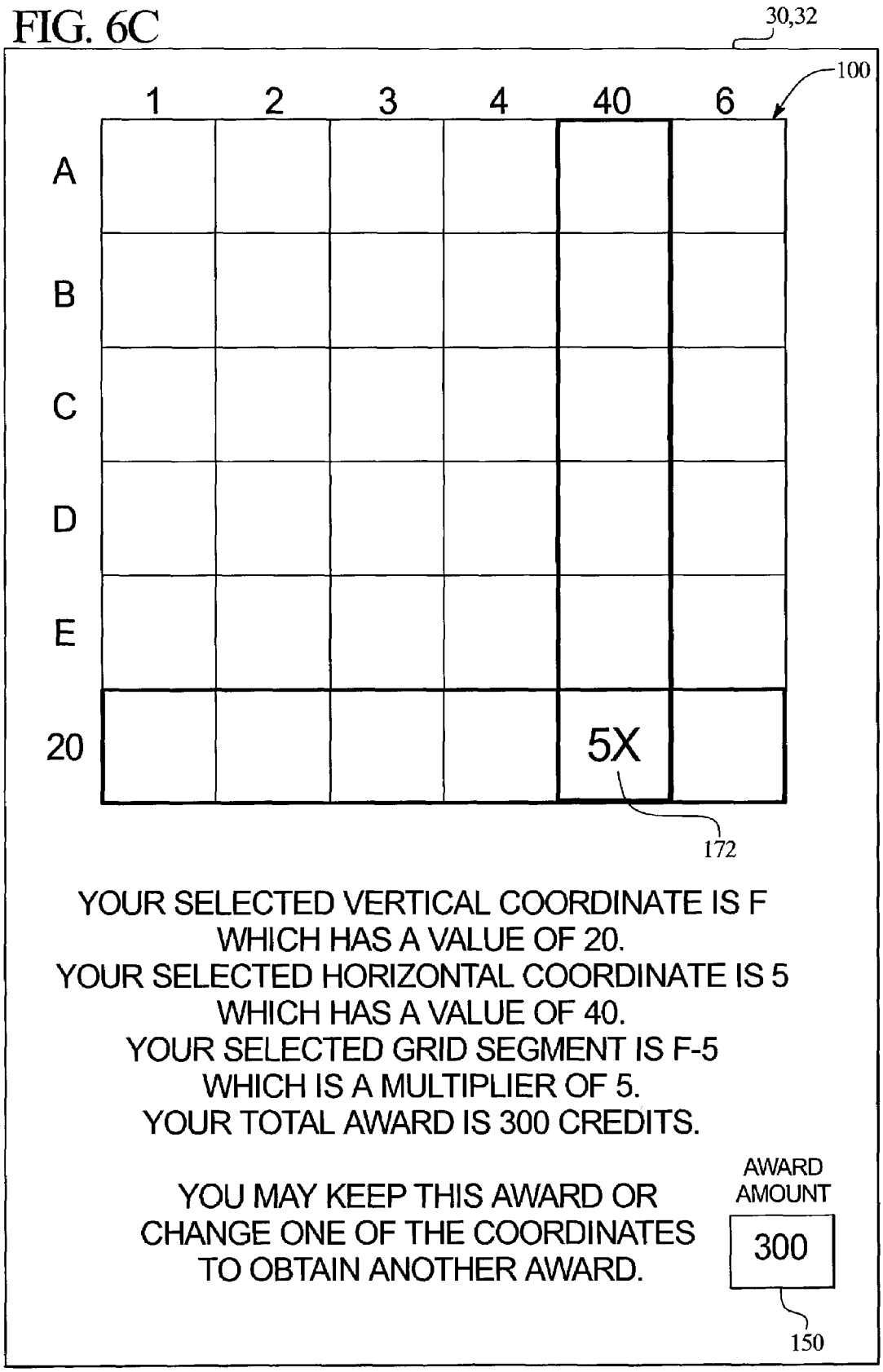

A further example of one embodiment of the present invention is illustrated in FIGS. 6A to 6D. In FIG. 6A, the display device displays a plurality of columns labeled 1 through 6 and a plurality of rows labeled A through F. The player is directed to select a vertical coordinate and a horizontal coordinate. As illustrated in FIG. 6B, the player selects horizontal coordinate column 5 and the display device displays the value associated with the horizontal coordinate 5 which is 40. The display device also highlights column 5 and informs the player to select the vertical coordinate. As further illustrated in FIG. 6C, the player selects the vertical coordinate F and the display device reveals the value of 20 associated with the coordinate or row F as well as the multiplier 5× or other modifier associated with the coordinate grid segment F5. The display device informs the player that the player's selected vertical coordinate is F which has a value of 20, the selected horizontal coordinate is 5 which has a value of 40, and the selected grid segment is F-5 which has a multiplier of 5. The display device also informs the player that the total award is 300 and that the player may keep this award or change one of the coordinates to obtain another award.

Figure 6D:
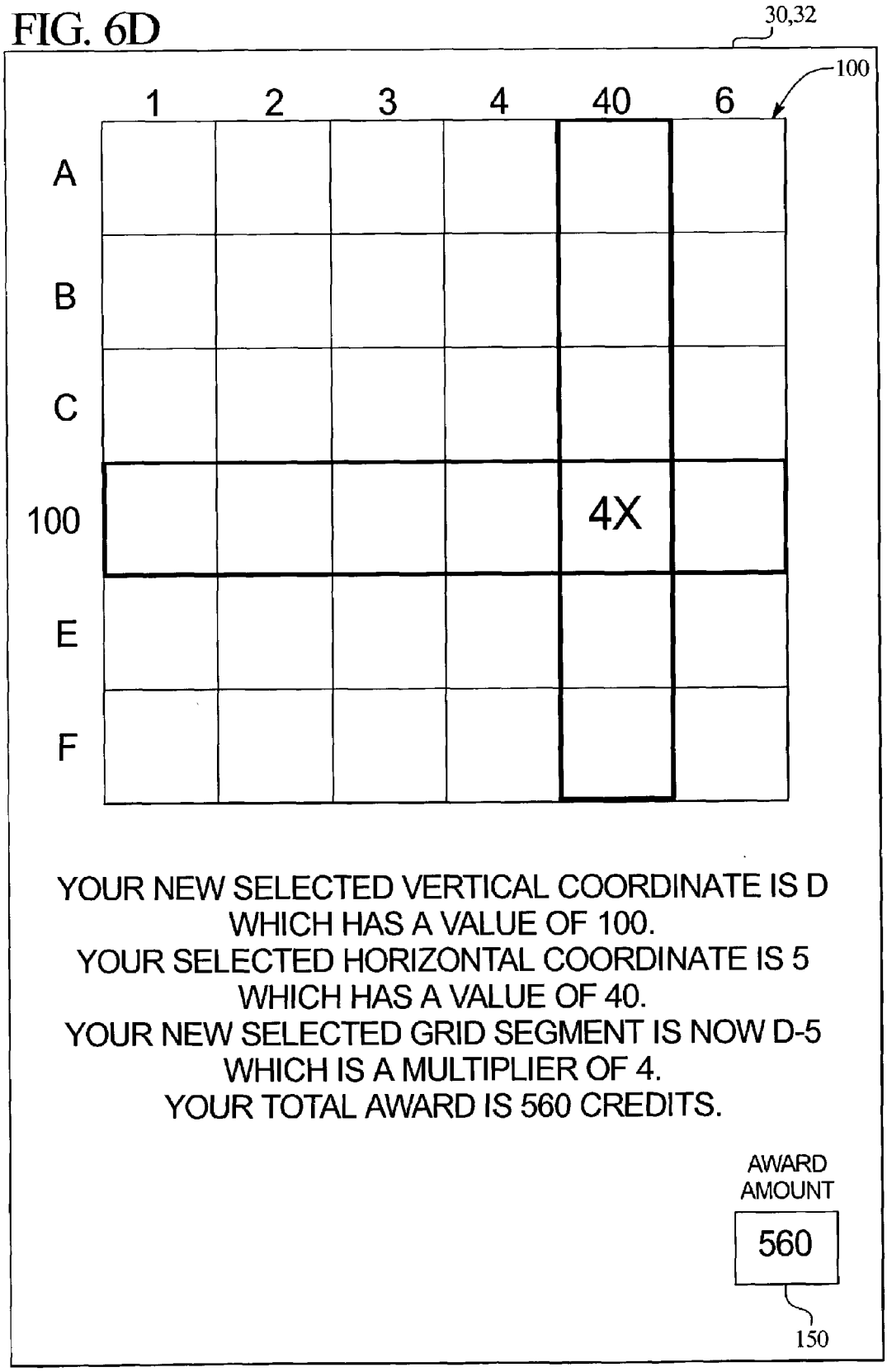

As further illustrated in FIG. 6D, the player changes the vertical coordinate to D and the display device displays the award value of 100 associated with the coordinate D. The multiplier associated with grid segment D5 is 4×. The gaming device display also informs players that the player's new selected coordinate is D which has an award value of 100, that the selected horizontal coordinate is 5 which has an award value of 40, and that the selected grid segment is now D5 which has a multiplier of 4. The display device also informs the player that the total award is 560 credits. In one embodiment which enables the player to make only one change of a coordinate, the player is provided the award after the change if the player decides to make the change.

In other alternative embodiments, the gaming device may enable the player to change the coordinates more than once. Alternatively, the gaming device may allow one change of each coordinate, multiple changes of one coordinate, multiple changes of both coordinates and variations thereof. The gaming device may also determine the number of changes based on some other random event or player interactive event or otherwise. Alternatively, the processor may randomly make the changes or the player and the processor may each make one or more of the changes. It should also be appreciated that in one embodiment of the present invention, the display device may display to the player or reveal to the player the ranges of values in the rows, or in and/or columns each of the different rows and/or columns and the range of multipliers or other modifiers in the grid segments which enables the player to make informed decisions. Accordingly, it should be appreciated that if the player picks a high value in a row or column, the player may want to change the other coordinate to obtain a maximum corresponding value and corresponding multiplier.

It should also be appreciated that the modifier could alternatively be other awards such as bonus credits or awards represented by bonus game symbols, bonus games represented by bonus game symbols, free game or spins represented by free game or spin symbols, and other usable or function elements of a game represented by usable symbols.

Figure 7A:
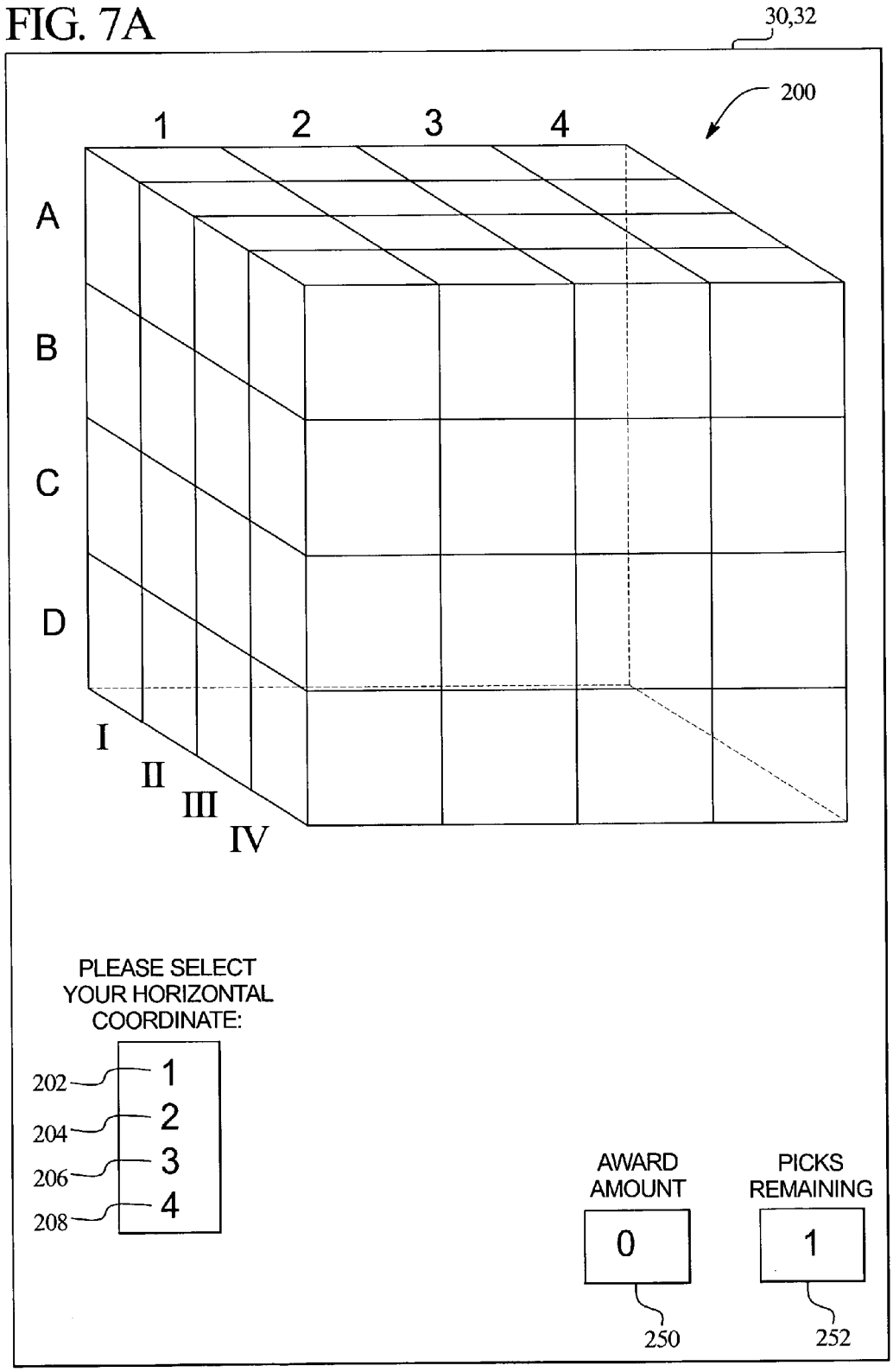
FIGS. 7A to 7C are front elevational views of an alternative embodiment of the present invention illustrating a three dimensional grid.
Figure 7B:
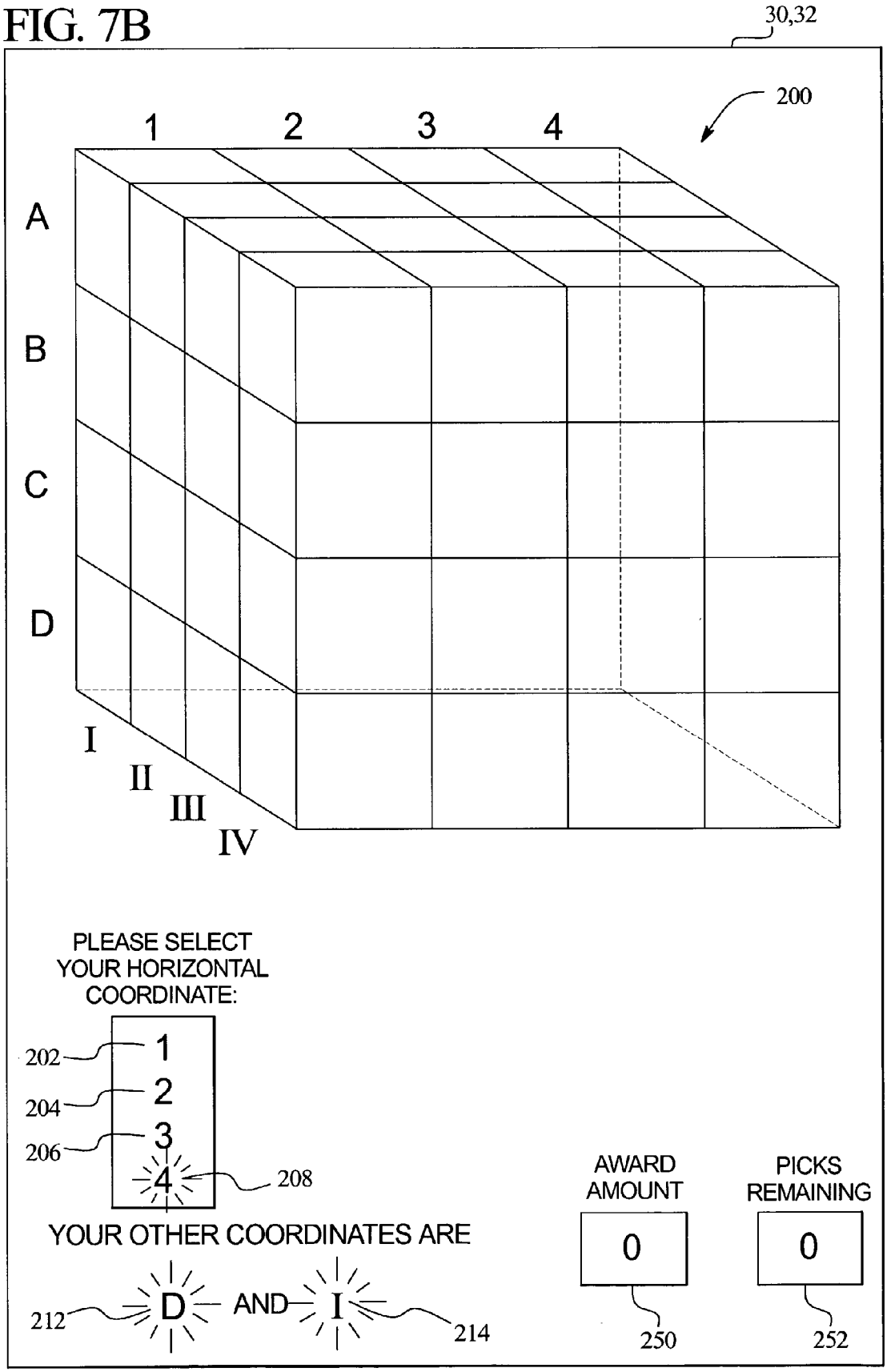
Figure 7C:
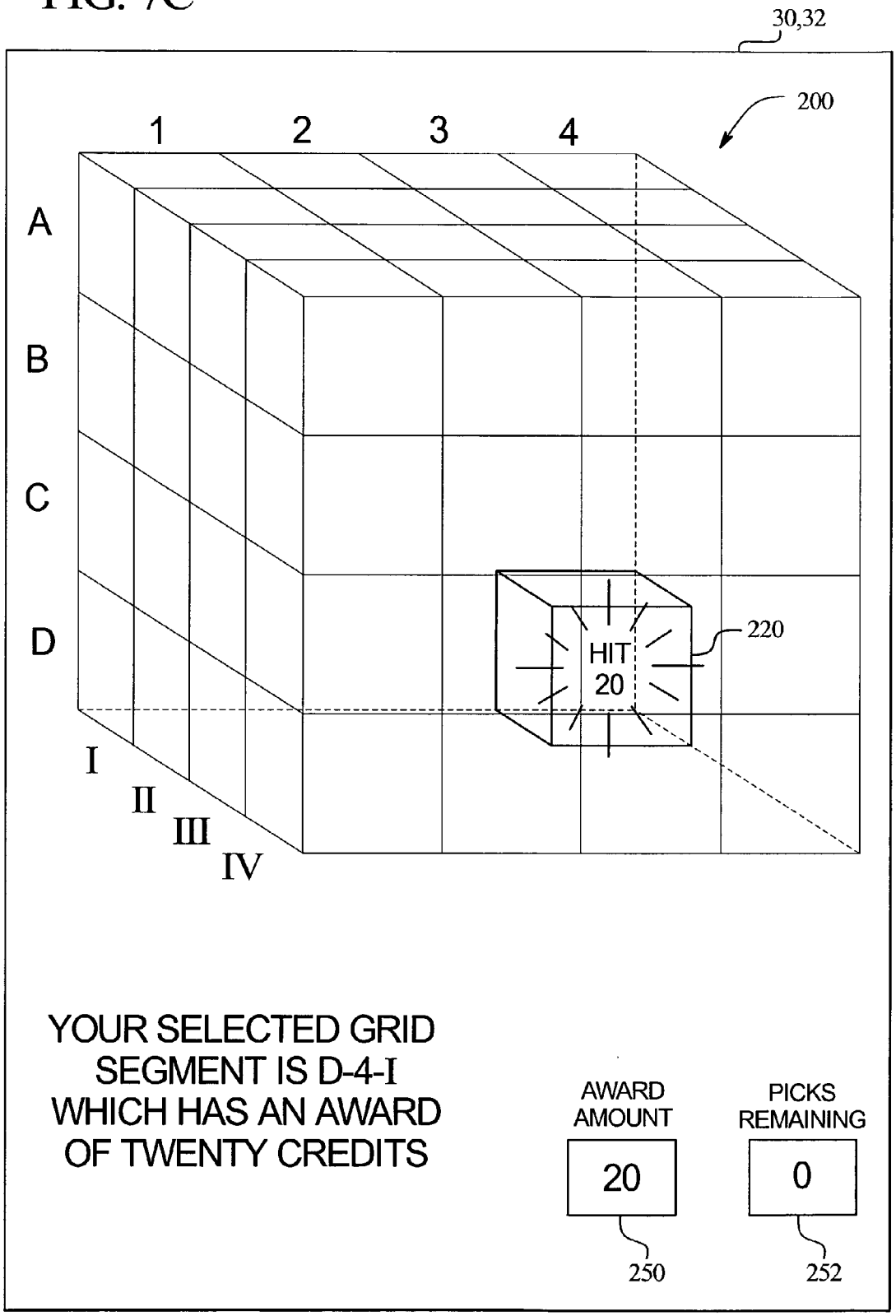

In another alternative embodiment, as illustrated in FIGS. 7A to 7C, the gaming device displays more than two coordinates such as three coordinates in a three dimensional grid with first or horizontal, second or vertical and third or depth coordinates. This embodiment proceeds as described above, however since there are three coordinates for each grid segment, in alternative embodiments, the player may individually and independently select zero, one, two or three coordinates of a grid segment to be revealed, with the processor of the gaming device randomly but independently selecting three, two, one or zero coordinates, respectively.

Referring to FIG. 7A, the gaming device provides a segmented three dimensional grid 200. Upon the initiation of the game, the gaming device provides the player a number of opportunities to select grid segments. In this case, the gaming device provided the player one opportunity, displayed in the picks remaining display 252. In this embodiment, the gaming device prompts the player to select one of four independently selectable horizontal coordinates 202, 204, 206 and 208 labeled 1, 2, 3 and 4, respectively. In this embodiment, the gaming device will randomly, but independently, select the other coordinates of the grid segment to be revealed. As seen in FIG. 7B, the player individually and independently selected highlighted horizontal coordinate 4 numbered 208. The gaming device randomly but independently selected coordinates D numbered 212 and 1 numbered 214. As revealed in FIG. 7C, selected grid segment D-4-1 had an associated award of twenty as indicated by the highlighted "hit 20" symbol 220. Accordingly, the award amount display 250 displayed an award amount of twenty. Appropriate messages such as "PLEASE SELECT YOUR HORIZONTAL COORDINATE" and "YOUR SELECTED GRID SEGMENT IS D-4-I WHICH HAS AN AWARD OF TWENTY CREDITS" are preferably provided to the player visually, or through suitable audio or audiovisual displays. It should be appreciated that the embodiments described above in relation to the two coordinate grid segment can be employed for grid segments having more than two coordinates.

Figure 8:
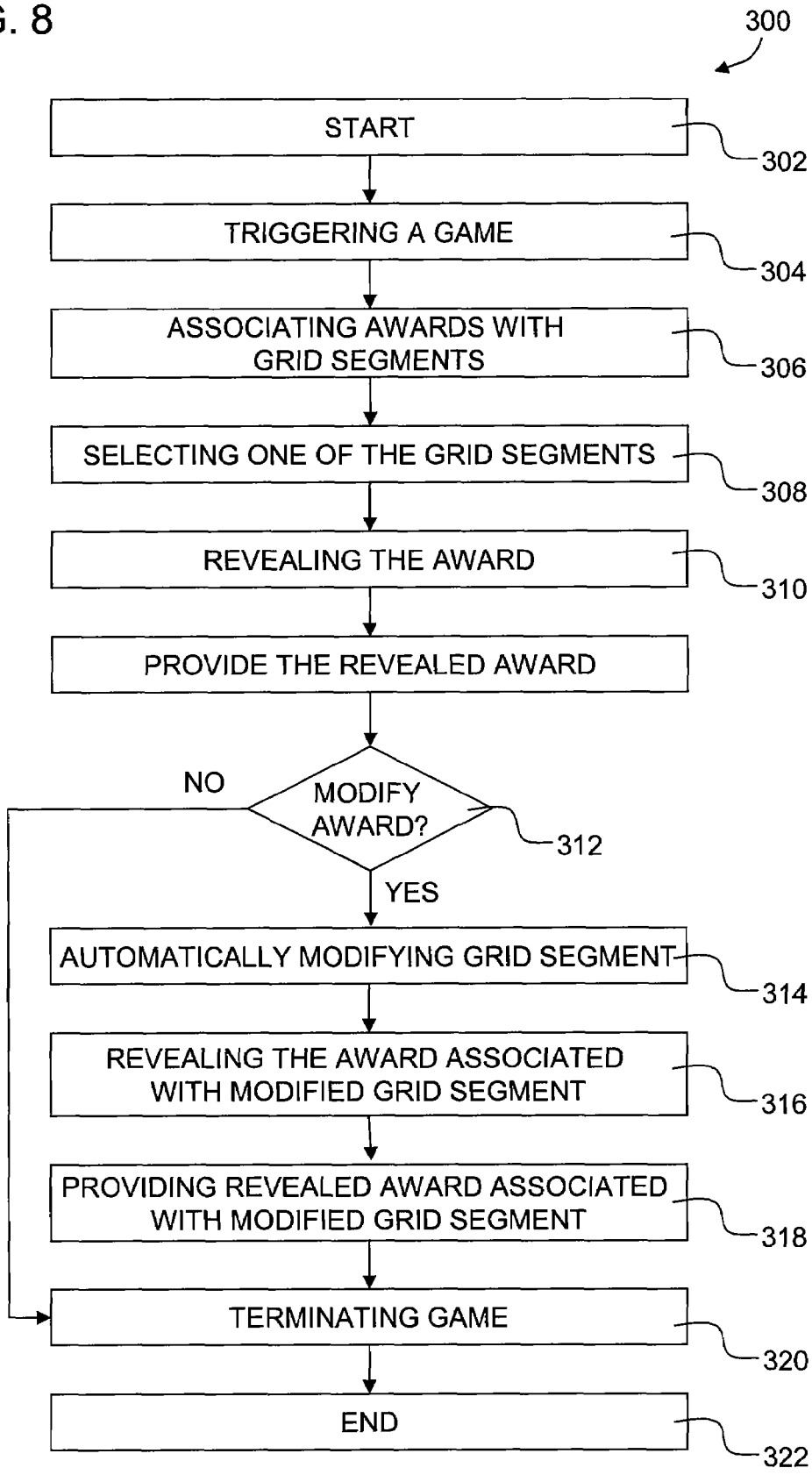
FIG. 8 is a flowchart showing an example process for operating a wagering gaming device.

A flowchart of an example process 300 for operating a wagering gaming device is illustrated in FIG. 8. In one embodiment, the process is embodied in one or more software programs stored in one or more memories and executed by one or more processors. Although the process 300 is described with reference to the flowchart illustrated in FIG. 8, it should be appreciated that many other methods of performing the acts associated with process 300 may be used. For example, the order of many of the blocks may be changed, and many of the blocks described may be optional.

Generally, the process 300 starts at block 302 and enables a gaming device operable under control of a processor to trigger a game at block 304. After the game is triggered, the processor associates a plurality of awards with a plurality of grid segments at block 306. The processor enables selection of one of the grid segments at block 308. Each grid segment is at least defined by an independently selectable first or horizontal coordinate and an independently selectable second or vertical coordinate. Selection of one of the grid segments includes independent selection of at least the first and second coordinates. In one embodiment, a player selects either the first coordinate or the second coordinate. If the player selects the first coordinate of the selected grid segment, the processor is operable and programmed to select the second coordinate of the selected grid segment. Alternatively, if the player selects the second coordinate of the selected grid segment, the processor is operable and programmed to select the first coordinate of the selected grid segment.

After selection of one of the grid segments, the processor causes a display device to reveal the award, if any, associated with the selected grid segment at block 310. In one embodiment, after the award is revealed, the processor may determine to modify the award at block 312. If the processor does not determine to modify the award at block 312, the processor terminates the game at block 320. However, if the processor determines to modify the award, the processor may automatically, and independently, change the first coordinate, the second coordinate or both. The modified grid segment corresponding to the changed coordinate(s) replaces the initially selected grid segment. This would result in the player no longer obtaining the revealed award, if any, associated with the initially selected and revealed grid segment. Rather, the processor causes a display device to reveal the award, if any, associated with the modified grid segment at block 316 and the gaming device provides the revealed award, if any, associated with the modified grid segment to the player at block 318. Alternatively, the player may obtain both awards, the higher award or the lower award. In one embodiment, the processor modifies the selected grid segment or the modified grid segment multiple times. After the gaming device provides the revealed award, if any, to the player, the processor terminates the game at block 320. After the game is terminated, the process 300 ends at block 322.

Figure 9:
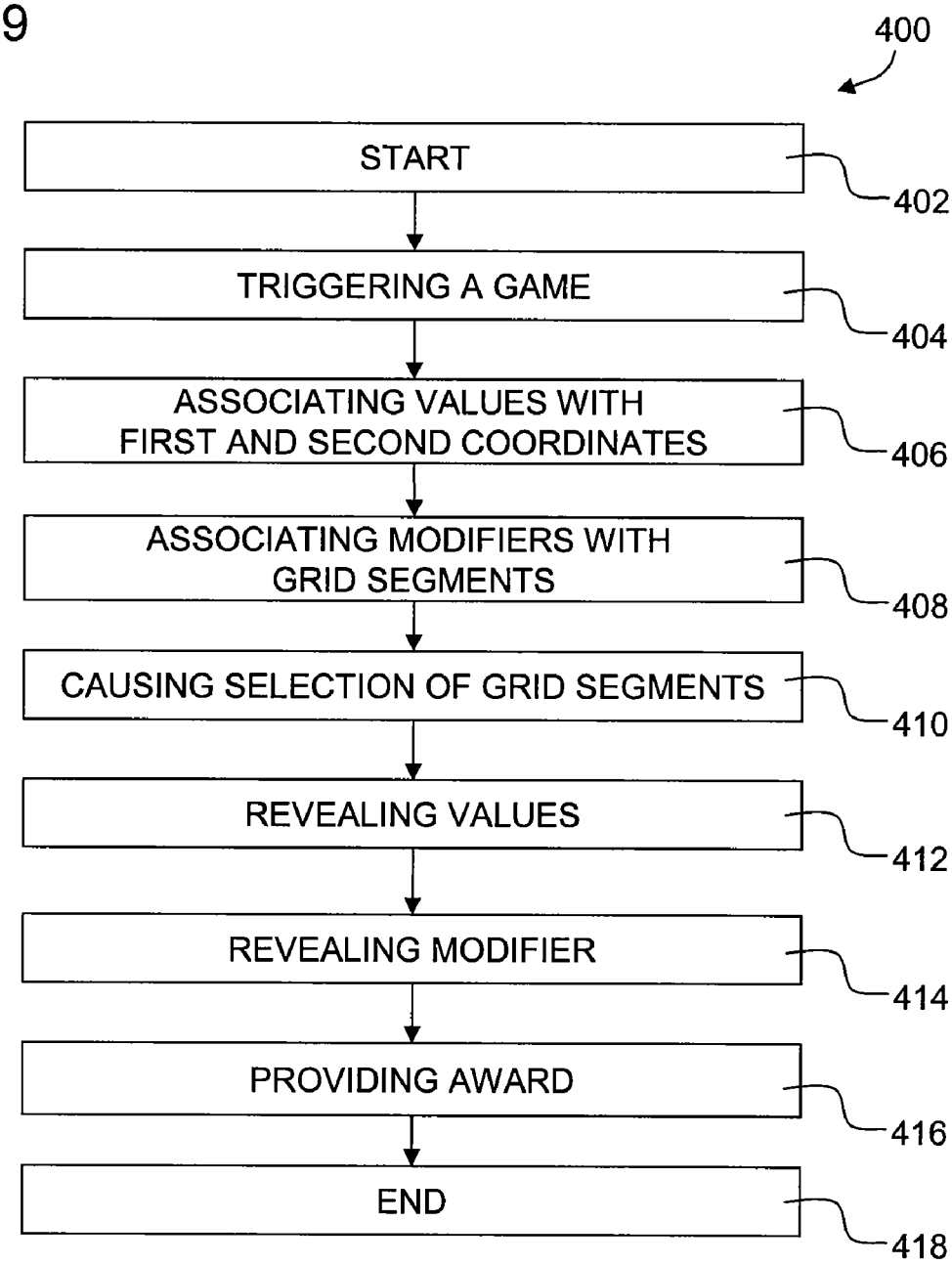
FIG. 9 is a flowchart showing an example process for operating a wagering gaming device.

A flowchart of an example process 400 for operating a wagering gaming device is illustrated in FIG. 9. In one embodiment, the process is embodied in one or more software programs stored in one or more memories and executed by one or more processors. Although the process 400 is described with reference to the flowchart illustrated in FIG. 9, it should be appreciated that many other methods of performing the acts associated with process 400 may be used. For example, the order of many of the blocks may be changed, and many of the blocks described may be optional.

Generally, the process 400 starts at block 402 and enables a gaming device operable under control of a processor to trigger a game at block 404. After the game is triggered, the gaming device associates a plurality of first or horizontal coordinates and a plurality of second or vertical coordinates with masked values, such as credit or dollar amounts, at block 406. The processor also associates a plurality of grid segments defined by the first and second coordinates with a plurality of awards, such as a modifier, at block 408. The processor causes selection of one of the grid segments at block 410. As described above, the player and/or the processor may independently select the first and second coordinates of the selected grid segment. For example, if a player selects a first coordinate of a selected grid segment, the processor may select the second coordinate of the selected grid segment.

After one of the grid segments is selected, the processor causes a display device to reveal the masked values, if any, associated with the independently selected first and second coordinates at block 412. The processor also causes a display device to reveal the award or modifier, if any, associated with the selected grid segment at block 414. In one embodiment, the processor causes the display device to reveal the value, the award or the modifier associated with each first coordinate, each second coordinate, and each grid segment. A player's award, if any, is based on a combination of the revealed value associated with the independently selected first coordinate, the revealed value associated with the independently selected second coordinate and the revealed award associated with the selected grid segment. The gaming device provides the player's award to the player at block 416 and the process 400 ends at block 418.

While the present invention is described in connection with what is presently considered to be the most practical and preferred embodiments, it should be appreciated that the invention is not limited to the disclosed embodiments, and is intended to cover various modifications and equivalent arrangements included within the spirit and scope of the claims. Modifications and variations in the present invention may be made without departing from the novel aspects of the invention as defined in the claims, and this application is limited only by the scope of the claims.

The invention is claimed as follows:

1. A gaming device comprising:

a plurality of independently selectable first coordinates;

a plurality of independently selectable second coordinates;

a plurality of independently selectable third coordinates, wherein the first coordinates, the second coordinates and the third coordinates intersect to define a plurality of grid segments which form a grid;

a plurality of awards associated with said plurality of grid segments;

a display device operable to display the grid; and a processor programmed to operate with the display device to:

(a) select one of the grid segments wherein at least one of said first coordinate, said second coordinate or said third coordinate of the selected grid segment is automatically selected by said processor and wherein at least one of said first coordinate, said second coordinate or said third coordinate of the selected grid segment is selected by a player;

(b) receive an inputted player selection of:

(i) said first coordinate of the selected grid segment if the processor selected either of the second coordinate of the selected grid segment or the third coordinate of the selected grid segment, (ii) said second coordinate of the selected grid segment if the processor selected either of the first coordinate of the selected grid segment or the third coordinate of the selected grid segment, or (iii) said third coordinate of the selected grid segment if the processor selected either of the first coordinate of the selected grid segment or the second coordinate of the selected grid segment;

(c) reveal the award, if any, associated with the selected grid segment; and (d) provide the revealed award, if any, to the player.

2. The gaming device of claim 1, wherein the processor is operable to receive two independent player selections selected from said first coordinates, said second coordinates and said third coordinates.

3. The gaming device of claim 1, wherein the plurality of awards are randomly selected from at least one pool of awards.

4. The gaming device of claim 1, wherein the number of awards are less than, greater than or equal to the number of grid segments.

5. The gaming device of claim 1, wherein the processor is operable to receive independent player selections of at least one of said first coordinates and at least two of said second coordinates.

6. The gaming device of claim 1, wherein the processor is operable to receive independent player selections of a plurality of said first coordinates and a plurality of said second coordinates.

7. The gaming device of claim 1, wherein the processor is operable to randomly associate said plurality of awards with said plurality of grid segments.

8. The gaming device of claim 1, wherein said processor is operable with the display device to cause said revealed awards to remain revealed for at least one subsequent grid segment selection.

9. The gaming device of claim 1, wherein the processor is operable with the display device to reveal the awards associated with the non-selected grid segments.

10. The gaming device of claim 1, which includes a number of player picks of said grid segments.

11. The gaming device of claim 10, wherein the number of player picks are predetermined.

12. The gaming device of claim 10, wherein the number of player picks are randomly determined.

13. The gaming device of claim 10, wherein the number of player picks are determined by the play of a preceding game.

14. A gaming device comprising:

a plurality of independently selectable first coordinates;

a plurality of independently selectable second coordinates, wherein the first coordinates and the second coordinates intersect to define a plurality of grid segments which form a grid;

a plurality of awards randomly associated with said plurality of grid segments;

a display device operable to display the grid; and a processor programmed to operate with the display device to:

(a) first automatically randomly select either one of said first coordinates or one of said second coordinates, (b) then receive an inputted player selection of:

(i) at least one of said first coordinates if the processor selected one of the second coordinates, or (ii) at least one of said second coordinates if the processor selected one of the first coordinates, (c) reveal the award, if any, associated with the selected grid segment which is based on the first and second coordinates selected by the processor and the player, and (d) provide said revealed award, if any, to a player.

15. The gaming device of claim 14, which includes a plurality of independently selectable third coordinates, wherein the first, second and third coordinates define the plurality of grid segments of the grid.

16. The gaming device of claim 15, wherein the processor randomly selects one of said third coordinates.

17. A gaming device comprising:

a plurality of independently selectable first coordinates;

a plurality of independently selectable second coordinates, wherein the first coordinates and the second coordinates intersect to define a plurality of grid segments which form a grid;

a display device operable to display the grid; and a processor programmed to operate with the display device to:

(a) first receive either an inputted player selection of at least one of said first coordinates or an inputted player selection of at least one of said second coordinates, (b) then automatically randomly select:

(i) at least one of said first coordinates if the inputted player selection of at least one of said second coordinates is received, or (ii) at least one of said second coordinates if the inputted player selection of at least one of said first coordinates is received, (c) reveal the award, if any, associated with the selected grid segment, which is based on the first and second coordinates selected by the player and the processor, and (d) provide said revealed award, if any, to a player.

18. The gaming device of claim 17, which includes a plurality of independently selectable third coordinates, wherein the first, second and third coordinates define the plurality of grid segments.

19. The gaming device of claim 18, wherein the processor randomly selects one of said third coordinates.

20. A gaming device comprising:

a plurality of independently selectable first coordinates;

a plurality of independently selectable second coordinates, wherein the first coordinates and the second coordinates intersect to define a plurality of grid segments which form a grid;

a plurality of awards associated with said plurality of grid segments;

a display device operable to display the grid; and a processor programmed to operate with the display device to:

(a) receive an independent player selection of either one of said first coordinates or one of said second coordinates, (b) then automatically randomly select:

(i) at least one of said first coordinates if the independent player selection of at least one of said second coordinates is received, or (ii) at least one of said second coordinates if the independent player selection of at least one of said first coordinates is received, (c) reveal the award, if any, associated with the selected grid segment based on the selections of the first coordinate and second coordinate, (d) receive an input indicating whether the player accepts said revealed award, if any, or the player independently changes the first coordinate, and (e) if the player changes the first coordinate, reveal the award, if any, associated with the new selected grid segment based on said changed first coordinate and said second coordinate.

21. The gaming device of claim 20, which includes providing to the player the award, if any, associated with the new selected grid segment based on said changed first coordinate and said second coordinate.

22. A gaming device comprising:

a plurality of independently selectable first coordinates;

a plurality of independently selectable second coordinates, wherein the first coordinates and the second coordinates intersect to define a plurality of grid segments which form a grid;

a plurality of awards associated with said plurality of grid segments;

a display device operable to display the grid; and a processor programmed to operate with the display device to:

(a) receive an independent player selection of one of said first coordinates and one of said second coordinates, (b) reveal the award, if any, associated with the selected grid segment based on the player's selection of the first coordinate and second coordinate, (c) receive an inputted player selection, wherein said inputted player selection indicates whether the player accepts said revealed award, if any, or the player causes the processor to independently change the first coordinate, (d) if the player causes the processor to independently change the first coordinate, randomly independently change the first coordinate, and (e) if the processor changes the first coordinate, reveal the award, if any, associated with the new selected grid segment based on said changed first coordinate and said second coordinate.

23. The gaming device of claim 22, which includes providing to the player the award, if any, associated with the new selected grid segment based on said changed first coordinate and said second coordinate.

24. A gaming device comprising:

a plurality of independently selectable first coordinates;

a plurality of independently selectable second coordinates, wherein the first coordinates and the second coordinates intersect to define a plurality of grid segments which form a grid;

a plurality of awards associated with said plurality of grid segments;

a display device operable to display the grid; and a processor programmed to operate with the display device to:

(a) cause the independent selection of one of the first coordinates and one of the second coordinates, (b) reveal any award associated with the selected grid segment, (c) for each independent selection of one of the first coordinates and one of the second coordinates, automatically cause the selection of another grid segment by changing one of the coordinates, and (d) reveal any award associated with the automatically selected grid segment.

25. The gaming device of claim 24, wherein the processor independently selects one of the first coordinates and one of the second coordinates.

26. The gaming device of claim 24, wherein the processor receives independent player selections of one of the first coordinates and one of the second coordinates.

27. The gaming device of claim 24, wherein the processor selects another grid segment by randomly changing one of the coordinates.

28. The gaming device of claim 24, wherein the player selects another grid segment by randomly changing one of the coordinates.

29. A gaming device comprising:

a plurality of independently selectable first coordinates;

a plurality of independently selectable second coordinates, wherein the first coordinates and the second coordinates intersect to define a plurality of grid segments which form a grid;

a plurality of awards associated with said plurality of grid segments;

a display device operable to display the grid; and a processor programmed to operate with the display device to:

(a) receive independent player selections of one of said first coordinates and one of said second coordinates to select at least one grid segment;

(b) reveal the award, if any, associated with the player selected grid segment;

(c) for each player selected grid segment, automatically randomly change one of said player's selected first coordinate with an independently selected first coordinate;

(d) reveal the award, if any, associated with the grid segment; and (e) provide said award, if any, to the player.

30. The gaming device of claim 29, wherein the processor is operable to receive an acceptance or a rejection of said award, if any, by the player prior to said change of one of said player's selected first coordinates.

31. A gaming device comprising:

a plurality of independently selectable first coordinates;

a plurality of independently selectable second coordinates, wherein the first coordinates and the second coordinates intersect to define a plurality of grid segments which form a grid;

a plurality of awards associated with said plurality of grid segments;

a display device operable to display the grid; and a processor programmed to operate with the display device to:

(a) receive a player selection of a plurality of said first coordinates and a plurality of said second coordinates, (b) select a grid segment by independently selecting one of said plurality of player selected first coordinates and one of said plurality of player selected second coordinates, (c) reveal the award, if any, associated with the selected grid segment, and (d) provide the revealed award, if any, to the player.

32. A gaming device comprising;

a plurality of first coordinates;

a plurality of second coordinates;

one or more first coordinate awards, wherein said first coordinate awards are associated with said plurality of first coordinates regardless of said plurality of second coordinates;

one or more second coordinate awards, wherein said second coordinate awards are associated with said plurality of second coordinates regardless of said plurality of first coordinates;

a plurality of segments, each said segment defined by an intersection of one of the first coordinates and one of the second coordinates;

a selected segment, wherein said selected segment is selected from said plurality of segments through independent selection of one of the first coordinates and one of the second coordinates; and an award based on the first coordinate award associated with the first coordinate of said selected segment or the second coordinate award associated with the second coordinate of said selected segment.

33. The gaming device of claim 32, which includes means for the player to independently select at least one of the first or second coordinates.

34. The gaming device of claim 33, which includes means for independently changing one of the selected first or second coordinates to modify said award.

35. A gaming device comprising:

a plurality of independently selectable first coordinates;

a plurality of independently selectable second coordinates, wherein the first coordinates and the second coordinates intersect to define a plurality of grid segments which form a grid;

a plurality of usable symbols associated with said plurality of grid segments;

a display device operable to display said grid; and a processor programmed to operate with the display device to:

(a) select one of the grid segments by receiving from a player either an independent selection of one of said first coordinates or an independent selection of one of said second coordinates and said processor automatically independently selecting:

(i) one of said first coordinates if the independent selection of one of said second coordinates is received, or (ii) one of said second coordinates if the independent selection of one of the first coordinates is received, and (b) reveal the usable symbol, if any, associated with the selected grid segment.

36. The gaming device of claim 35, wherein the usable symbol is selected from the group consisting of multiplier symbols, bonus award symbols, bonus game symbols, free game symbols and credit symbols.

37. The gaming device of claim 36, at least two of the usable symbols are co-acting symbols.

38. The gaming device of claim 37, wherein the two co-acting usuable symbols are associated with adjacent grid segments.

39. The gaming device of claim 37, wherein the processor is operable to provide the player the award associated with said two usable symbols when the grid segments associated with said two usable symbols are selected.

40. The gaming device of claim 35, which includes a plurality of independently selectable third coordinates, wherein the first, second and third coordinates define said plurality of grid segments.

41. The gaming device of claim 40, wherein the processor is operable to facilitate the independent selection one of the third coordinates.

42. A gaming device comprising:

a plurality of independently selectable first coordinates;

a plurality of independently selectable second coordinates, wherein the first coordinates and the second coordinates intersect to define a plurality of grid segments;

a plurality of modifiers associated with said grid segments;

a plurality of values associated with a plurality of the first and a plurality of the second coordinates;

a display device; and a processor programmed to operate with the display device to:

(a) receive independent player selections of one of said first coordinates and one of said second coordinates to select at least one grid segment, (b) reveal the value, if any, associated with each player selected first coordinate and second coordinate, (c) reveal the modifier, if any, associated with the player selected grid segment, and (d) provide the player a total award based on any said revealed values and any said revealed modifier.

43. The gaming device of claim 42, wherein the processor is operable to reveal the value, if any, associated with the first coordinates and second coordinates.

44. A gaming device comprising:

a plurality of independently selectable first coordinates;

a plurality of independently selectable second coordinates, wherein the first coordinates and the second coordinates intersect to define a plurality of grid segments;

a plurality of modifiers associated with said grid segments;

a plurality of values associated with a plurality of the first coordinates and a plurality of the second coordinates;

a display device; and a processor programmed to operate with the display device to:

(a) cause the selection of at least one grid segment by causing the independent selection of one of said first coordinates and one of said second coordinates, (b) reveal the value, if any, associated with each selected first coordinate and second coordinate, (c) reveal the modifier, if any, associated with the selected grid segment, and (d) provide a player a total award based on any said revealed values and any said revealed modifier.

45. The gaming device of claim 44, wherein one of the values is associated with each of the first coordinates and each of the second coordinates.

46. The gaming device of claim 44, wherein the modifiers are multipliers.

47. A gaming device comprising:

a plurality of independently selectable first coordinates;

a plurality of independently selectable second coordinates, wherein the first coordinates and the second coordinates intersect to define a plurality of grid segments;

a plurality of modifiers associated with said grid segments;

a plurality of values associated with a plurality of the first and a plurality of the second coordinates;

a display device; and a processor programmed to operate with the display device to:

(a) receive independent player selections of one of said first coordinates and one of said second coordinates to select one of the grid segments, (b) reveal the value, if any, associated with each player selected first coordinate and second coordinate, (c) reveal the modifier, if any, associated with the player selected grid segment, (d) receive an input indicating whether the player accepts an award which is based on any said revealed values and any said revealed modifier or the player randomly independently changes the first coordinate, and (e) if the player changes the first coordinate, reveal the value, if any, associated with the changed first coordinate and reveal the modifier, if any, associated with the changed grid segment.

48. The gaming device of claim 47, which includes providing to the player a changed award based on any said revealed value for the changed first coordinate, said selected second coordinate and any said revealed modifier.

49. The gaming device of claim 47, wherein each said value is associated with a different one of the first coordinates or the second coordinates.

50. The gaming device of claim 47, wherein the modifiers are multipliers.

51. A gaming device comprising:

a plurality of independently selectable first coordinates;

a plurality of independently selectable second coordinates, wherein the first coordinates and the second coordinates intersect to define a plurality of grid segments;

a plurality of modifiers associated with said grid segments;

a plurality of values associated with a plurality of the first and a plurality of the second coordinates;

a display device; and a processor programmed to operate with the display device to:

(a) cause the selection of at least one grid segment by the independent selection of one of said first coordinates and one of said second coordinates;

(b) reveal the value, if any, associated with each selected first coordinate and second coordinate, (c) reveal the modifier, if any, associated with the selected grid segment, (d) receive an input indicating whether a player accepts an award which is based on said revealed values and revealed modifier or causes the random independent change of the selected first coordinate to another one of said first coordinates, and (e) if the first coordinate is changed, reveal the value, if any, associated with the changed first coordinate and reveal the modifier, if any, associated with the grid segment defined by the changed first coordinate and the selected second coordinate.

52. The gaming device of claim 51, which includes providing to the player a changed award based on any said revealed value for the changed first coordinate, said second coordinate said second coordinate and any said revealed modifier.

53. The gaming device of claim 51, wherein each said value is associated with a different one of the first coordinates or the second coordinates.

54. The gaming device of claim 51, wherein the modifiers are multipliers.

55. A method of operating a wagering gaming device, said method comprising the steps of:

(a) associating a plurality of awards with a plurality of grid segments;

(b) selecting one of said grid segments by independently selecting first and second coordinates which intersect to define said grid segments, wherein a player selects either one of said independently selected first and second coordinates of said selected grid segment and wherein a processor is programmed to automatically select:

(i) said independently selected first coordinate of said selected grid segment if the player selects said independently selected second coordinate, or (ii) said independently selected second coordinate of said selected grid segment if the player selects said independently selected first coordinate;

(c) revealing the award, if any, associated with said selected grid segment; and (d) providing the revealed award, if any, to a player.

56. The method of claim 55, which includes repeating steps (b) through (c) at least once.

57. The method of claim 55, wherein the step of selecting the grid segment includes receiving an independent player selection of at least one of the first and second coordinates.

58. The method of claim 55, wherein the step of selecting the grid segment includes said processor randomly independently selecting at least one of the first and second coordinates.

59. The method of claim 55, which includes the step of modifying one of the selected first and second coordinates to determine another grid segment, and providing a player the award, if any, associated with said grid segment.

60. The method of claim 55, wherein the award, if any, revealed in step (d) remains revealed for at least one subsequent pick of one of the grid segments.

61. The method of claim 55, which further includes the step of revealing the awards associated with the non-selected grid segments.

62. The method of claim 55, wherein at least one award in step (b) is associated with a plurality of adjacent grid segments.

63. The method of claim 62, wherein step (d) include revealing any partial award associated with adjacent grid segments.

64. The method of claim 55, which includes operating the gaming device through a data network.

65. The method of claim 64, wherein the data network is an internet.

66. A method of operating a gaming device, said method comprising the steps of:

(a) triggering a game;

(b) associating a plurality of awards with a plurality of grid segments defined by a plurality of first coordinates and a plurality of second coordinates, each grid segment being defined by an intersection of one of the first coordinates and one of the second coordinates;

(c) receiving an inputted player selection of one of said first coordinates;

(d) automatically randomly independently selecting one of the second coordinates, wherein a processor is programmed to automatically randomly independently select one of the second coordinates after the inputted player selection is received;

(e) revealing the award, if any, associated with the selected grid segment defined by the selected first coordinate and the selected second coordinate;

(f) providing the revealed award, if any, to the player; and (g) terminating the game.

67. The method of claim 66, which includes repeating steps (c) to (e) at least once.

68. The method of claim 66, which includes operating the gaming device through a data network.

69. The method of claim 68, wherein the data network is an internet.

70. A method of operating a gaming device, said method comprising the steps of:

(a) triggering a game;

(b) associating a plurality of awards with a plurality of grid segments;

(c) selecting one of said grid segments by independently selecting first and second coordinates which intersect to define said grid segments;

(d) revealing the award, if any, associated with said selected grid segment;

(e) automatically modifying the selected grid segment by independently changing at least one of the selected first and second coordinates;

(f) revealing the award, if any, associated with the modified grid segment;

(g) providing the revealed award, if any, from step (f) to a player; and (h) terminating the game.

71. The method of claim 70, which includes operating the gaming device through a data network.

72. The method of claim 71, wherein the data network is an internet.

73. A method of operating a gaming device, said method comprising the steps of:

(a) triggering a game;

(b) associating a plurality of values with a plurality of independently selectable first coordinates and independently selectable second coordinates of a grid;

(c) associating a plurality of modifiers with a plurality of grid segments defined by an intersection of said first and second coordinates;

(d) causing the selection of one of said grid segments by causing the independent selection of one of the first coordinates and one of the second coordinates;

(e) revealing the values, if any, associated with the independently selected first and second coordinates;

(f) revealing the modifier, if any, associated with said selected grid segment; and (g) providing an award to a player based on said revealed values, if any, and said revealed modifier, if any.

74. The method of claim 73, which includes causing one of the selected first coordinates to be changed to reveal one of the values, if any, associated with the changed first coordinate and one of the modifiers, if any, associated with the changed grid segment.

75. The method of claim 73, which includes operating the gaming device through a data network.

76. The method of claim 75, wherein the data network is an internet.

* * * * *

UNITED STATES PATENT AND TRADEMARK OFFICE

CERTIFICATE OF CORRECTION

PATENT NO. : 7,300,348 B2
APPLICATION NO. : 10/210540
DATED : November 27, 2007
INVENTOR(S) : Kaminkow et al.

It is certified that error appears in the above-identified patent and that said Letters Patent is hereby corrected as shown below:

In Column 1, Line 34, delete “a” between “of” and “two”

In Column 1, Line 40, change “players” to --player’s--

In Column 1, Line 48, change “players” to --player’s--

In Column 1, Line 49, delete “of” between “discloses” and “a”

In Column 7, Line 48, change “The” to --There--

In Column 10, Line 25, change “had” to --if--

In Column 10, Line 25, change “if” to --had--

In Column 12, Line 27, change “1” to --I--

In Column 12, Line 29, change “D-4-1” to --D-4-I--

In Column 19, Line 29, change “36” to --35--

In Column 19, Line 32, change “usuable” to --usable--

In Column 21, Line 36, delete “said second coordinate” between “coordinate” and “and”

Signed and Sealed this

Thirtieth Day of December, 2008

JON W. DUDAS
*Director of the United States Patent and Trademark Office*